US010675668B2

(12) United States Patent
Kohno

(10) Patent No.: US 10,675,668 B2
(45) Date of Patent: Jun. 9, 2020

(54) DEVICE AND METHOD OF SHIM ADJUSTING OF DIE-CUSHION DEVICE

(71) Applicant: AIDA ENGINEERING, LTD., Kanagawa (JP)

(72) Inventor: Yasuyuki Kohno, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 541 days.

(21) Appl. No.: 15/492,837

(22) Filed: Apr. 20, 2017

(65) Prior Publication Data

US 2017/0304887 A1 Oct. 26, 2017

(30) Foreign Application Priority Data

Apr. 22, 2016 (JP) ..... 2016-086075

(51) Int. Cl.
*B21D 24/14* (2006.01)
*B21D 24/02* (2006.01)

(52) U.S. Cl.
CPC ..... *B21D 24/14* (2013.01); *B21D 24/02* (2013.01)

(58) Field of Classification Search
CPC ..... B21D 24/02; B21D 24/10; B21D 24/14
See application file for complete search history.

(56) References Cited

U.S. PATENT DOCUMENTS 5,687,598 A * 11/1997 Kirii ..... B21D 24/14 72/21.5
9,132,463 B2 * 9/2015 Ota ..... B21D 24/14
9,669,446 B2 * 6/2017 Kohno ..... B21D 24/02

FOREIGN PATENT DOCUMENTS

JP 06-066822 U 9/1994

* cited by examiner

*Primary Examiner* — Teresa M Ekiert
(74) *Attorney, Agent, or Firm* — McDermott Will & Emery LLP

(57) ABSTRACT

A plurality of hydraulic cylinders capable of adjusting height direction positions of a plurality of die-cushion pins that are inserted into a plurality of die-cushion pin holes formed in a bolster, respectively, are arranged in a lattice state on a cushion pad, and the hydraulic cylinder faced with a die-cushion pin located below a projection surface of a blank holder in the plurality of hydraulic cylinders is selected. Then, by independently adjusting a height direction position of a piston rod of each of the selected hydraulic cylinders, respectively, the shim adjustment of substantially each of the die-cushion pins is realized.

18 Claims, 22 Drawing Sheets

FIG.17

USE 1 / NON-USE 0

| C-HOLE \ DIE | DIENo.1 | DIENo.2 | ····· | DIENo.54 | DIENo.55 |
|---|---|---|---|---|---|
| C1 | 0 | 1 | ····· | 0 | 0 |
| C2 | 1 | 1 | ····· | 0 | 0 |
| C3 | 1 | 1 | ····· | 1 | 0 |
| C4 | 1 | 1 | ····· | 1 | 0 |
| C5 | 1 | 1 | ····· | 0 | 0 |
| ⋮ | ⋮ | ⋮ | ⋮ | ⋮ | ⋮ |
| C51 | 1 | 1 | ····· | 0 | 0 |
| C52 | 1 | 1 | ····· | 1 | 0 |
| C53 | 1 | 1 | ····· | 1 | 0 |
| C54 | 1 | 1 | ····· | 0 | 0 |
| C55 | 0 | 1 | ····· | 0 | 0 |

FIG.18

SHIM THICKNESS SET VALUE

| C-HOLE \ DIE | DIENo.1 | DIENo.2 | ····· | DIENo.54 | DIENo.55 |
|---|---|---|---|---|---|
| C1 | 0.00 | 0.20 | ····· | 0.00 | 0.00 |
| C2 | 0.00 | 0.30 | ····· | 0.00 | 0.00 |
| C3 | 0.30 | 0.10 | ····· | 0.20 | 0.00 |
| C4 | 0.40 | 0.25 | ····· | 0.40 | 0.00 |
| C5 | 0.60 | 0.15 | ····· | 0.00 | 0.00 |
| ⋮ | ⋮ | ⋮ | ⋮ | ⋮ | ⋮ |
| C51 | 0.60 | 0.16 | ····· | 0.00 | 0.00 |
| C52 | 0.40 | 0.27 | ····· | 0.30 | 0.00 |
| C53 | 0.30 | 0.15 | ····· | 0.10 | 0.00 |
| C54 | 0.00 | 0.20 | ····· | 0.00 | 0.00 |
| C55 | 0.00 | 0.20 | ····· | 0.00 | 0.00 |

DEVICE AND METHOD OF SHIM ADJUSTING OF DIE-CUSHION DEVICE

CROSS REFERENCE

This patent application claims the benefit of Japanese Patent Application No. 2016-086075, filed on Apr. 22, 2016, the entire contents of each are hereby incorporated by reference.

BACKGROUND OF THE INVENTION

Field of the Invention

The present invention relates to a device and a method of shim adjusting of a die-cushion device and particularly to a technology of efficiently performing shim adjustment in the die-cushion device.

Description of the Related Art

A die-cushion device applies a die-cushion force to a cushion pad (that is, a blank holder) between die-cushion strokes from a die-cushion standby position to a press bottom dead center in a state where an upper die and a lower die (blank holder) are in close contact through a material.

In this type of the die-cushion device, a wrinkle suppressing degree by the blank holder for each die is subjected to "shim adjustment" through trial and error (a forming trial is performed and attachment/detachment of the shim, an increase/decrease of a thickness and the like are repeated while a forming result is checked) in a form in which shims made of a sheet metal with respective thicknesses are manually inserted between a die-cushion pin and the blank holder at each portion.

On the other hand, a pressure control device of a die-cushion pin disposed on a die-cushion pad and constituted such that a plurality of hydraulic cylinders each supporting the die-cushion pin is divided into a plurality of groups and pressure control is executed independently for each of the hydraulic cylinders in each of the divided groups is proposed (Japanese Utility Model Registration Application Laid-Open No. 06-066822).

The invention described in Japanese Utility Model Registration Application Laid-Open No. 06-066822 has two objects, one of which is to cause the die-cushion force to uniformly act on a deviation in a length of the die-cushion pin caused by permanent deformation of the die-cushion pin involved in a long-time use, and the other of which is to enable adjustment of the die-cushion pressure for each group of the plurality of hydraulic cylinders in order to perform appropriate forming depending on a shape of an article to be formed when press drawing of a sheet iron or the like is performed.

SUMMARY OF THE INVENTION

A die-cushion device used in a first process of a production line of an automobile body has some 200 die-cushion pins supporting a blank holder, and "shim adjustment" performed by manually inserting a shim made of sheet metal having an arbitrary thickness into each portion of the some 200 die-cushion pins and the blank holder is an exhausting work requiring a period of a half to a whole day or more for each die particularly when a new die is to be used.

Moreover, when a die having experienced the "shim adjustment" is to be used, the shim made of a sheet metal having an appropriate thickness is manually inserted while checking a shim list which records results of the "shim adjustment". However, there is a problem that a human error can occur that the shim made of a sheet metal is inserted into a wrong spot or the like and the thickness of the shim made of a sheet metal to be inserted is wrong.

Furthermore, in a press machine, the dies are replaced after production of a certain quantity (8000 to 10000, for example), and the "shim adjustment" needs to be performed at every replacement of the dies. Thus, more efficient shim adjustment is in demand, but there is no shim adjusting device targeted to higher efficiency of the "shim adjustment" at present.

On the other hand, regarding a pressure control device of the die-cushion pin described in Japanese Utility Model Registration Application Laid-Open No. 06-066822, since the pressure control is executed after the hydraulic cylinders are divided into a plurality of groups, the die-cushion force cannot be adjusted for each die-cushion pin, and adjustment of the die-cushion force is insufficient. That is, it is difficult to make a strong or weak die-cushion force act on a specific shaped portion in a formed product having a complicated shape, which leads to a problem that accurate distribution of the die-cushion force cannot be applied easily.

When the hydraulic cylinder is disposed for each die-cushion pin and a pressure of each hydraulic cylinder is to be individually adjusted, the die-cushion pressure which bears the die-cushion force needs to be individually adjusted for the number of the die-cushion pins, which increases the number of devices to be adjusted (controlled) and leads to a problem that the device and control become cumbersome in constituting the entire device. Moreover, a size of the device increases in proportion to the number of adjustment mechanisms, and since the pressure control needs to be kept functioning at any time during forming for each cycle, at least a price soars and it is not realistic. Therefore, the invention described in Japanese Utility Model Registration Application Laid-Open No. 06-066822 is considered to be constituted such that the hydraulic cylinders to be subjected to pressure control are divided (limited) to a plurality of groups.

The present invention was made in view of such circumstances and has an object to provide a device and a method of shim adjusting of a die-cushion device which can efficiently perform shim adjustment.

In order to achieve the aforementioned object, a shim adjusting device of a die-cushion device according to an aspect of the present invention is, in a die-cushion device having a cushion pad configured to support a blank holder through a plurality of die-cushion pins and a cushion-pad elevating mechanism configured to support the cushion pad and generate a die-cushion force when a slide of a press machine is lowered, the shim adjusting device, the shim adjusting device includes a plurality of fluid pressure cylinders disposed on the cushion pad and disposed at positions faced with a plurality of die-cushion pin holes formed in a bolster of the press machine, a lower end of each of the plurality of die-cushion pins inserted into the plurality of die-cushion pin holes being in contact with a piston rod; a fluid pressure device configured to supply an operating fluid independently to each of rise-side pressurizing chambers of the plurality of fluid pressure cylinders, respectively, or discharge the operating fluid from the rise-side pressurizing chamber; and a shim adjustment control device configured to cause the operating fluid to be supplied independently from the fluid pressure device to rise-side pressurizing chambers of fluid pressure cylinders respectively corresponding to die-cushion pins to be used in the plurality of die-cushion pins inserted into the plurality of die-cushion pin holes, the die-cushion pins to be used transmitting a die-cushion force to the blank holder, and independently adjust a height direction position of the piston rod of each of the fluid pressure cylinders respectively corresponding to the die-cushion pins to be used, respectively.

According to the aspect of the present invention, by disposing the plurality of fluid pressure cylinders each capable of adjusting the height direction positions of the plurality of die-cushion pins inserted into the plurality of die-cushion pin holes formed in the bolster on the cushion pad and by independently adjusting the height direction position of the piston rod of each of the fluid pressure cylinders, respectively, the height direction position of the die-cushion pin in contact with the piston rod of each of the fluid pressure cylinders can be adjusted, respectively. The prior-art shim adjustment is of a staged adjustment type by a thickness (0.2 mm, 0.4 mm and the like)×number of the shims made of a sheet metal, while the present invention is of a non-stage adjustment type, which improves adjustment accuracy. Moreover, in the prior-art shim adjustment, insertion/removal into/from between the die-cushion pin—blank holder and thickness adjustment of the shim made of a sheet metal are performed manually and thus, one shim adjustment work at one spot takes approximately 5 minutes. However, it can be reduced to approximately 30 seconds in the present invention, whereby a series of the shim adjustment works which took a half day in total can be completed in approximately 30 minutes, or reduction of the shim adjustment work time can be utilized for checking of formability of a product or fine adjustment, whereby product accuracy can be improved.

In a shim adjusting device of a die-cushion device according to another aspect of the present invention, it is preferable that the shim adjustment control device includes a shim thickness setting device, the shim thickness setting device includes a die-cushion pin selector configured to select the die-cushion pins to be used in the plurality of die-cushion pins to be inserted into the plurality of die-cushion pin holes; and a shim thickness setter configured to set a plurality of shim thickness set values corresponding to the plurality of die-cushion pins to be used selected by the due-cushion pin selector, the shim thickness setter setting an arbitrary shim thickness set value to each of the die-cushion pins to be used, and the shim adjustment control device causes the operating fluid to be supplied independently from the fluid pressure device to the rise-side pressurizing chambers of the fluid pressure cylinders corresponding to the die-cushion pins to be used, respectively, and independently adjust the height direction position of the piston rod of each of the fluid pressure cylinders respectively corresponding to the die-cushion pins to be used, based on the shim thickness set value of each of the die-cushion pins to be used set by the shim thickness setting device.

Since the number and arrangement of the die-cushion pins to be actually used (the die-cushion pins to be used which transmit a die-cushion force to a blank holder) are different depending on a die to be set on a press machine, it is configured such that the die-cushion pins to be actually used can be selected by the die-cushion pin selector from the die-cushion pins to be inserted into the plurality of die-cushion pin holes. A plurality of the shim thickness set values corresponding to the selected plurality of die-cushion pins to be used is made capable of being arbitrarily set for each of the die-cushion pins to be used by the shim thickness setter. The shim adjustment control device causes the operating fluid to be independently supplied from the fluid pressure device to the rise-side pressurizing chamber of the fluid pressure cylinder corresponding to each of the plurality of die-cushion pins to be used and independently adjusts a height direction position of a piston rod of each of the fluid pressure cylinders based on the shim thickness set value of each of the die-cushion pins to be used, respectively. As described above, the shim thickness set value of each die-cushion pin to be actually used can be set by the shim thickness setting device easily (and in a short time).

In a shim adjusting device of a die-cushion device according to still another aspect of the present invention, it is preferable that the shim adjusting control device further includes a storage operation unit configured to output a storage instruction for storing at least a shim thickness set value of each of the die-cushion pins to be used in a storage unit in association with a die to be used in the press machine or output a read-out instruction for reading out the shim thickness set value of each of the die-cushion pins to be used from the storage unit in association with the die to be used in the press machine; and a storage control unit configured to, when the storage instruction is input from the storage operation unit, store at least the shim thickness set value of each of the die-cushion pins to be used set by the shim thickness setting device in the storage unit in association with the die to be used in the press machine and when the read-out instruction is input from the storage operation unit, read out the shim thickness set value of each of the die-cushion pins to be used stored in association with the die to be used in the press machine from the storage unit, wherein the shim adjustment control device causes the operating fluid to be independently supplied from the fluid pressure device to the rise-side pressurizing chambers of the fluid pressure cylinders respectively corresponding to the die-cushion pins to be used and independently adjusts the height direction position of the piston rod of each of the fluid pressure cylinders respectively corresponding to the die-cushion pins to be used based on the shim thickness set value of each of the read-out die-cushion pins to be used when the shim thickness set value of each of the die-cushion pins to be used stored in association with the die to be used in the press machine is read out by the storage control unit from the storage unit based on an operation in the storage operation unit.

Since at least the shim thickness set value of each die-cushion pin to be used set by the shim thickness setting device in association with the die to be used in the press machine is stored in the storage unit, if a die having experienced the "shim adjustment" in the past is to be used, the shim thickness set value of each die-cushion pins to be used stored in association with the die is read out from the storage unit, and the height direction position of the piston rod of each of the fluid pressure cylinders can be independently adjusted based on the shim thickness set value of each of the read-out die-cushion pins to be used, respectively, whereby the shim adjustment can be performed automatically.

In a shim adjusting device of a die-cushion device according to still another aspect of the present invention, it is preferable that the fluid pressure cylinder is a single-rod type fluid pressure cylinder.

In a shim adjusting device of a die-cushion device according to still another aspect of the present invention, it is preferable that the fluid pressure device includes a fluid pressure source, a pressurization line through which the operating fluid is supplied from the fluid pressure source, a tank line connected to a tank, a plurality of first solenoid valves disposed in a plurality of lines connecting the rise-side pressurizing chambers of the plurality of fluid pressure cylinders and the pressurization line, respectively, and a plurality of second solenoid valves disposed in each of a plurality of lines connecting the rise-side pressurizing chambers of the plurality of fluid pressure cylinders and the tank line.

By executing ON/OFF control of the plurality of first solenoid valves and the plurality of second solenoid valves, supply and discharge of the operating fluid to the rise-side pressurizing chamber of the fluid pressure cylinder (that is, adjustment of the height direction position of the piston rod) corresponding to any one die-cushion pin to be used (the die-cushion pin to be used as an adjustment target) in the die-cushion pins to be used is enabled, and the fluid pressure device is made an inexpensive device with simple constitution.

In a shim adjusting device of a die-cushion device according to still another aspect of the present invention, it is preferable that the plurality of first solenoid valves and the plurality of second solenoid valves are non-leak type solenoid valves, respectively. That is because, when the height direction position of the piston rod of each of the fluid pressure cylinders is adjusted, though the first solenoid valve and the second solenoid valve corresponding to the adjusted fluid pressure cylinder are turned OFF, the height direction position of the piston rod of the adjusted fluid pressure cylinder is not changed by leakage of the operating fluid.

In a shim adjusting device of a die-cushion device according to still another aspect of the present invention, it is preferable that the shim adjustment control device controls the first solenoid valve, the second solenoid valve, and the fluid pressure source based on identification information of the plurality of die-cushion pin holes or identification information of the die-cushion pins to be inserted into the plurality of die-cushion pin holes and at least the shim thickness set value of each of the die-cushion pins to be used, independently supplies the operating fluid from the fluid pressure source to the rise-side pressurizing chambers of the fluid pressure cylinders respectively corresponding to the die-cushion pins to be used and independently adjusts the height direction position of the piston rod of each of the fluid pressure cylinders respectively corresponding to the die-cushion pins to be used.

In a shim adjusting device of a die-cushion device according to still another aspect of the present invention, it is preferable that the shim adjustment control device selects any one die-cushion pin to be used in the die-cushion pins to be used as an adjustment target based on the identification information, adjusts the height direction position of the piston rod of the fluid pressure cylinder corresponding to the die-cushion pin to be used as the adjustment target based on the shim thickness set value set correspondingly to the selected die-cushion pin to be used as the adjustment target and adjusts height-direction positions of piston rods of all the fluid pressure cylinders corresponding to the die-cushion pins to be used by sequentially switching the die-cushion pin to be used as the adjustment target.

In a shim adjusting device of a die-cushion device according to still another aspect of the present invention, it is preferable that the fluid pressure cylinder includes a spring configured to urge the piston rod in a lowering direction, and the shim adjustment control device adjusts the height direction position of the piston rod of the fluid pressure cylinder by controlling a pressure of the operating fluid supplied to the rise-side pressurizing chamber of the fluid pressure cylinder from the fluid pressure device.

In a shim adjusting device of a die-cushion device according to still another aspect of the present invention, assuming that a displacement constant of a height position of the piston rod with respect to the pressure of the operating fluid made to act on the rise-side pressurizing chamber of the fluid pressure cylinder is $K_{P/X}$, it is preferable that the displacement constant $K_{P/X}$ is $K_{P/X}$=0.3 [MPa/mm] to 30 [MPa/mm]. That is because the height position of the piston rod is controlled with high sensitivity with respect to the pressure of the operating fluid made to act on the rise-side pressurizing chamber of the fluid pressure cylinder and its change amount.

In a shim adjusting device of a die-cushion device according to still another aspect of the present invention, it is preferable that the spring is a disk spring disposed in a lowering-side pressurizing chamber of the fluid pressure cylinder. That is because the disk spring can be adjusted to a desired spring constant by a method of combining (stacking) commercial disk springs.

In a shim adjusting device of a die-cushion device according to still another aspect of the present invention, it is preferable that the shim adjustment control device controls the operating fluid to be supplied to the rise-side pressurizing chamber of the fluid pressure cylinder from the fluid pressure device based on a pressure instruction of the rise-side pressurizing chamber of the fluid pressure cylinder calculated based on the shim set value set for each of the die-cushion pins to be used and the pressure of the rise-side pressurizing chamber of the fluid pressure cylinder. The pressure instruction of the rise-side pressurizing chamber of the fluid pressure cylinder can be calculated as a pressure instruction substantially in proportion to the shim set value, and by controlling the pressure of the rise-side pressurizing chamber of the fluid pressure cylinder to a pressure corresponding to the pressure instruction, the height direction position of the piston rod of the fluid pressure cylinder (a rise amount of the die-cushion pin corresponding to the shim set value) can be adjusted.

In a shim adjusting device of a die-cushion device according to still another aspect of the present invention, it is preferable that the shim adjusting device further includes a pressure detector configured to detect a pressure generated in the pressurization line, and the shim adjustment control device controls the pressure of the operating fluid supplied to the pressurization line from the fluid pressure source based on the pressure instruction of the rise-side pressurizing chamber of the fluid pressure cylinder calculated based on the shim set value set for each of the die-cushion pins to be used and the pressure detected by the pressure detector and brings the pressure of the rise-side pressurizing chamber of the fluid pressure cylinder corresponding to the first solenoid valve subjected to ON control in the plurality of first solenoid valves to the pressure corresponding to the pressure instruction.

According to the above, when the height direction position of the piston rod of each of the fluid pressure cylinders is independently adjusted, the number of the pressure detectors can be only one, which enables constitution of an inexpensive device.

In a shim adjusting device of a die-cushion device according to still another aspect of the present invention, it is preferable that the shim adjusting device further includes a plurality of position detectors which detect the height direction positions of the piston rods of the plurality of fluid pressure cylinders, respectively, and the shim adjustment control device controls the operating fluid supplied to the rise-side pressurizing chamber of the fluid pressure cylinder from the fluid pressure device based on the shim thickness set value and the height direction position of the piston rod detected by the position detector.

According to the above, the height direction position of the piston rod of each of the fluid pressure cylinders can be controlled, respectively, and accuracy of the shim adjustment can be improved.

In a shim adjusting device of a die-cushion device according to still another aspect of the present invention, it is preferable that the die-cushion pin selector includes a display; a first display control unit configured to display at least a first layout and a second layout on a screen of the display, the first layout illustrating a layout of the plurality of die-cushion pin holes or a plurality of die-cushion pins inserted into the plurality of die-cushion pin holes, the second layout illustrating a layout of the die-cushion pin holes into which the die-cushion pins to be used are inserted or the die-cushion pins to be used; and a first operation unit configured to edit the second layout in a dialogue manner while checking the first layout and the second layout displayed on the screen of the display, the first display control unit displays the second layout on the screen of the display in accordance with an operation input from the first operation unit, and the die-cushion pin selector selects the die-cushion pin to be used based on the second layout displayed on the screen of the display.

According to the above, the second layout can be edited in the dialogue manner by operating the first operation unit while checking the first layout and the second layout displayed on the screen of the display, the die-cushion pin to be used can be selected based on the edited second layout, the selection of the die-cushion pin to be used can be made efficiently and the number and layout of the die-cushion pins to be used are easy to be understood.

In a shim adjusting device of a die-cushion device according to still another aspect of the present invention, it is preferable that the shim thickness setter includes the display; a second display control unit configured to display a shim thickness set value of each of the die-cushion pins to be used in association with the second layout displayed on the screen of the display, respectively; and a second operation unit configured to edit the shim thickness set value of each of the die-cushion pins to be used to an arbitrary shim thickness set value in dialogue manner, respectively, while checking the shim thickness set value displayed on the screen of the display, the second display control unit displays the arbitrary shim thickness set value edited in accordance with an operation input from the second operation unit on the screen of the display, and the shim thickness setter sets the shim thickness set value displayed on the screen of the display as the shim thickness set value of each of the die-cushion pins to be used.

According to the above, the shim thickness set value of each of the die-cushion pins to be used can be edited in the dialogue manner by operating the second operation unit while checking the second layout displayed on the screen of the display and the shim thickness set value set for each of the die-cushion pins to be used, and the setting of the shim thickness set value of each of the die-cushion pins to be used can be made efficiently.

In a shim adjusting device of a die-cushion device according to still another aspect of the present invention, it is preferable that the second operation unit has a function of selecting a plurality of the die-cushion pins to be used at the same time and editing each of the shim thickness set values of the die-cushion pins to be used selected at the same time into the same shim thickness set value. According to this, when there are many die-cushion pins to be used set to the same shim thickness set value, these die-cushion pins to be used can be collectively set to the same shim thickness set value, whereby the setting of the shim thickness set value of each of the die-cushion pins to be used can be made more efficiently.

A still another aspect of the present invention is a shim adjusting method of a die-cushion device using a shim adjusting device of any one of the die-cushion devices above and it is preferable that the method includes a first step of selecting die-cushion pins to be used in a plurality of die-cushion pins to be inserted into a plurality of die-cushion pin holes; a second step of setting a plurality of shim thickness set values corresponding to the plurality of die-cushion pins to be used selected by the first step to set an arbitrary shim thickness set values to each of the die-cushion pins to be used; a third step of independently adjusting a height direction position of a piston rod of each of fluid pressure cylinders respectively corresponding to the die-cushion pins to be used by causing an operating fluid to be supplied independently from the fluid pressure device to rise-side pressurizing chambers of the fluid pressure cylinders corresponding to the plurality of die-cushion pins to be used based on a shim thickness set value of each of the die-cushion pins to be used set by the second step; and a fourth step of performing a trial by driving a slide of a press machine after adjustment by the third step, wherein processing from the second step to the fourth step is repeated until a quality product is formed by the trial at the fourth step.

By referring to a forming result of the formed product by the trial (forming trial), the shim thickness set value of each of the die-cushion pins to be used is re-set (modified), the height direction position of the piston rod of each of the fluid pressure cylinders is adjusted, respectively, based on the modified shim thickness set value and performs the forming trial again. By repeating this, the height direction position (a rise amount of each of the die-cushion pins to be used) of the piston rod of each of the fluid pressure cylinders capable of forming a quality product is adjusted.

According to the present invention, since the height direction position of the piston rod of the fluid pressure cylinder corresponding in a one-to-one manner to each of the die-cushion pins to be used of the plurality of die-cushion pins to be used which supports the blank holder is made independently adjustable, respectively, and the rise amount of each of the die-cushion pins to be used corresponding to the shim thickness is adjusted, the shim adjustment can be performed efficiently as compared with the shim adjustment performed manually through insertion/removal of the shim made of a sheet metal in the prior-art, and since the shim adjustment becomes non-stage adjustment, adjustment accuracy can be improved as compared with the stepped adjustment through insertion/removal of the shim made of a sheet metal.

BRIEF DESCRIPTION OF THE DRAWINGS

FIG. 17 is a table indicating selection information of use/non-use of each of the die-cushion pins stored in a storage unit 249 in association with a die No.;

FIG. 18 is a table indicating the shim thickness set value of each of the die-cushion pins stored in a storage unit 249 in association with a die No.;

DETAILED DESCRIPTION OF THE EMBODIMENTS

Preferred embodiments of a device and a method of shim adjusting of a die-cushion device according to the present invention will be described below in detail by referring to the attached drawings.

Outline Configuration of Press Machine and Die-Cushion Device

Figure 1:
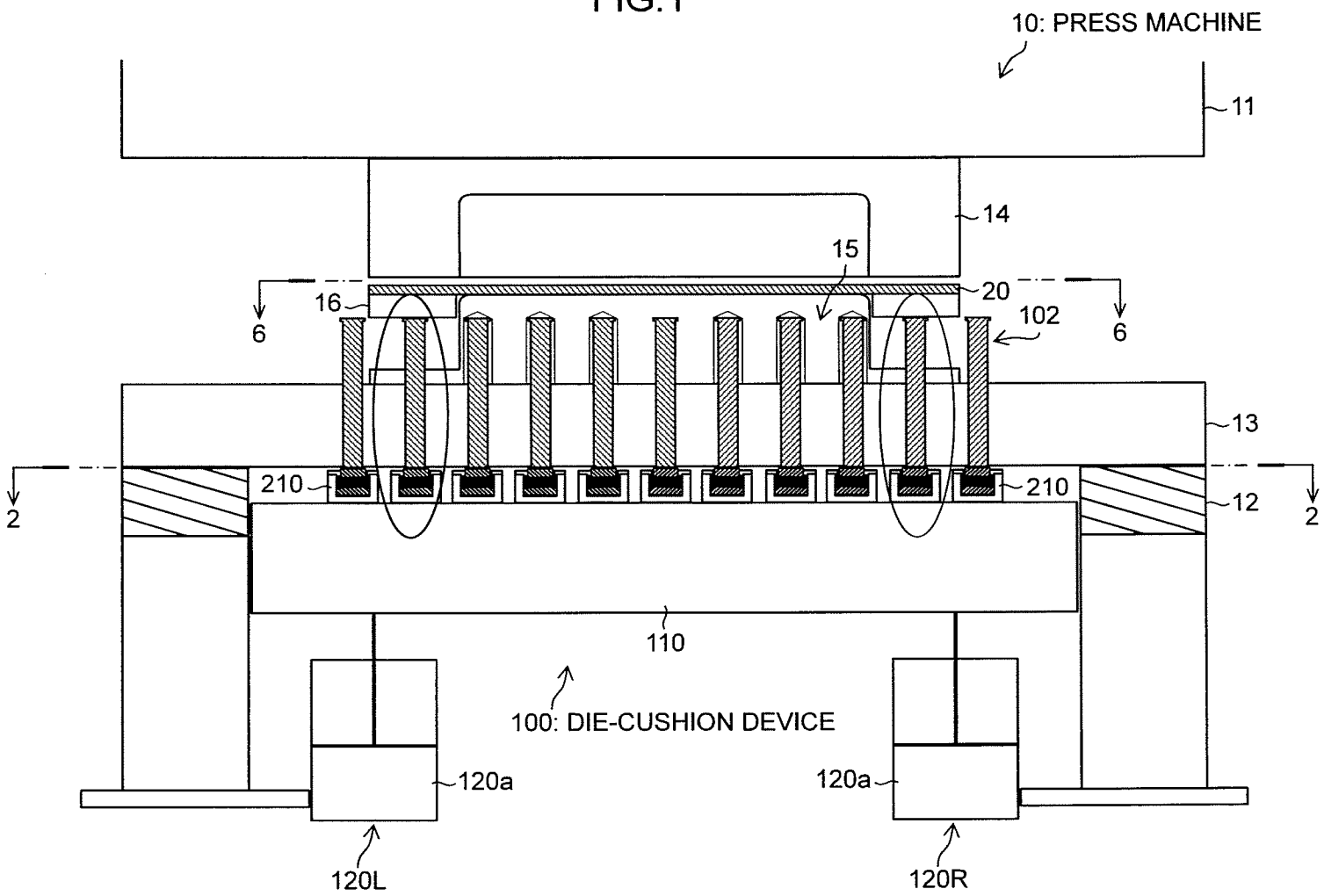
FIG. 1 is an outline configuration diagram illustrating an essential part of a press machine 10 and a die-cushion device including a shim adjusting device of the die-cushion device.
Figure 2:
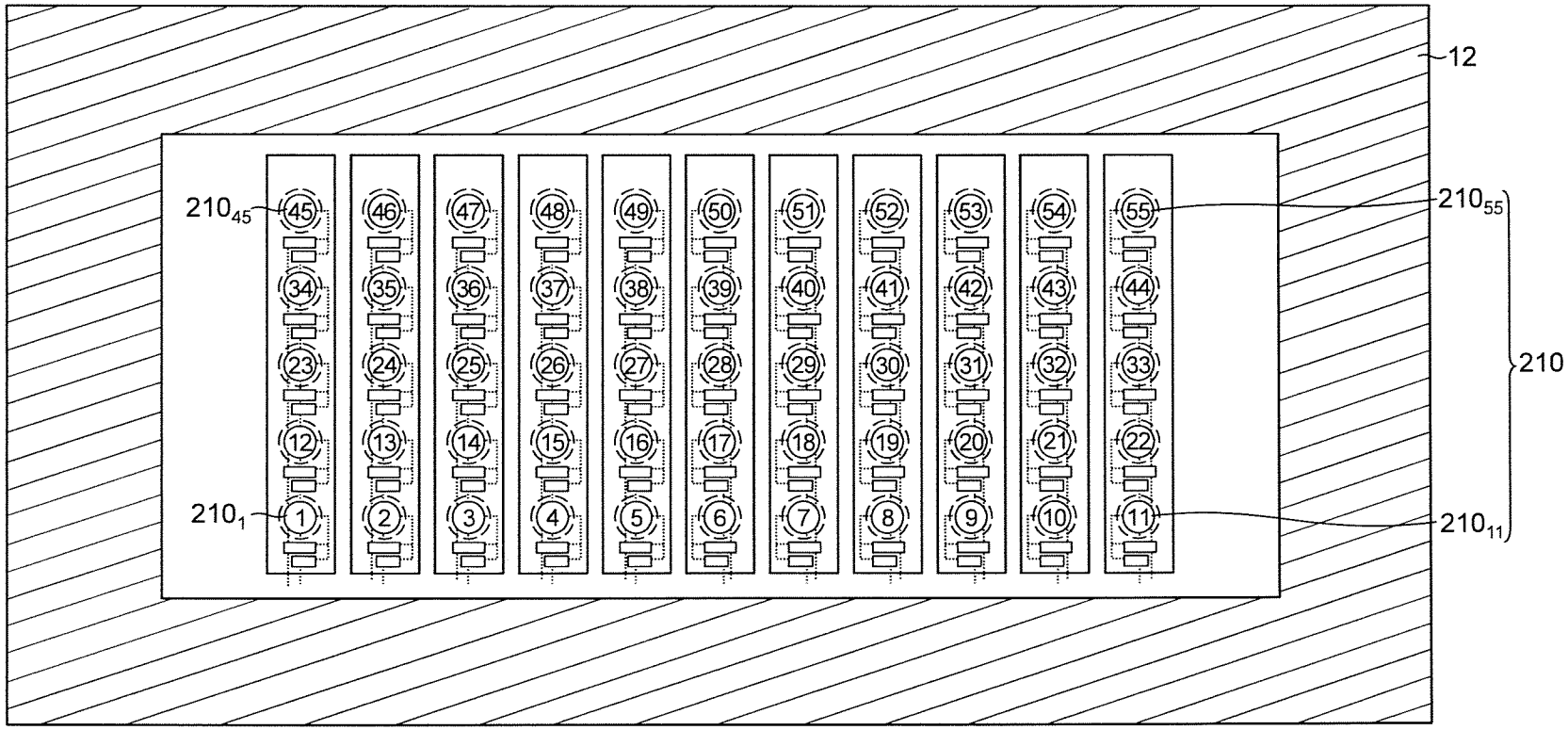
FIG. 2 is a plan view of an essential part of the die-cushion device 100 seen from a direction of an arrow 2 in FIG. 1.

FIG. 1 is an outline configuration diagram illustrating an essential part of a press machine 10 and a die-cushion device including a shim adjusting device of the die-cushion device according to the present invention. FIG. 2 is a plan view of an essential part of the die-cushion device 100 seen from a direction of an arrow 2 in FIG. 1.

In FIGS. 1 and 2, reference numeral 11 designates a slide of the press machine 10 and reference numeral 12 designates a bed of the press machine 10.

The slide 11 is guided by a frame (not shown) of the press machine 10 movably in a vertical direction and is moved in an up-and-down direction in FIG. 1 by a crank mechanism (not shown) including a crank shaft to which a rotary driving force is transmitted by a servomotor or a fly wheel.

On the bed 12 of the press machine 10, a bolster 13 having a plurality of die-cushion pin holes (hereinafter referred to as a "C-hole") is disposed. In the bolster 13 in this embodiment, 55 (11×5) C-holes arrayed in a lattice state are formed.

On a lower surface of the slide 11, an upper die 14 is disposed, while on an upper surface of the bolster 13, a lower die 15 is disposed. The upper die 14 in this embodiment is of a die type having a recess portion, while the lower die 15 is of a punch type having a projecting portion corresponding to the recess portion of the upper die 14.

Between the upper die 14 and the lower die 15, a blank holder (wrinkle pressing plate) 16 is arranged, a lower side of the blank holder 16 is supported by a plurality of die-cushion pins 102 inserted into the C holes in the bolster 13, and a material 20 is set on (in contact with) the upper side of the blank holder 16.

The press machine 10 performs press-forming of the material 20 between the upper die 14 and the lower die 15 by lowering the slide 11. Moreover, the die-cushion device 100 presses a peripheral edge of the material 20 from the lower side during the press-forming.

The number of die-cushion pins 102 is 55 which is the same number as the C-holes formed in the bolster 13, and the die-cushion pin 102 located below a projection surface of the blank holder 16 in the 55 die-cushion pins 102 becomes the die-cushion pin 102 transmitting a die-cushion force to the blank holder 16 (hereinafter referred to as a "die-cushion pin to be used"). Moreover, the die-cushion pins other than the die-cushion pin to be used in the 55 die-cushion pins 102 remain in a state inserted into the blank holder 16 in this embodiment and do not function as the die-cushion pin (wrinkle pressing) transmitting the die-cushion force to the blank holder 16.

The die-cushion device 100 includes a cushion pad 110, right and left two pneumatic cylinders 120L and 120R which function as cushion pad elevating mechanisms for generating a die-cushion force and a shim adjusting device 200 (FIG. 3) having a plurality of fluid pressure cylinders (hydraulic cylinders) 210 which functions as shim thickness generating devices.

The cushion pad 110 is supported by the pneumatic cylinders 120L and 120R, and a known pressure control circuit, not shown, is connected to cushion-pressure generation-side pressurizing chambers 120*a* of the pneumatic cylinders 120L and 120R.

The pressure control circuit controls the die-cushion force by adjusting a pressure generated in the cushion-pressure generation-side pressurizing chambers 120*a* of the pneumatic cylinders 120L and 120R (pressure of an air tank communicating with the cushion-pressure generation-side pressurizing chamber 120*a*) during an action of the die-cushion to a desired pressure.

The cushion-pad elevating mechanism for generating the die-cushion force is not limited to that using the pneumatic cylinders 120L and 120R, and various mechanisms including the one constituted by a hydraulic cylinder, a hydraulic motor for driving this hydraulic cylinder, and a servomotor, a mechanism using a screw-nut mechanism for elevating the cushion pad, a servomotor for driving this screw-nut mechanism, and a hydraulic damper and the like can be applied.

The plurality of hydraulic cylinders 210 functions as the shim thickness generating devices and is disposed on the cushion pad 110. That is, the plurality of hydraulic cylinders 210 is disposed at positions (under the projection surface of the C-hole) faced with the plurality of C-holes formed in the bolster 13 and disposed so that lower ends of the die-cushion pins 102 to be inserted into the C-holes are brought into contact with the piston rods of the hydraulic cylinders 210.

FIG. 2 illustrates 55 (11×5) hydraulic cylinders 210 (55 hydraulic cylinders $\mathbf{210}_1$ to $\mathbf{210}_{55}$ indicated by No. 1 to No. 55) arrayed in the lattice state on the cushion pad 110. FIG. 1 illustrates 11 pieces of the hydraulic cylinders 210 in one row in the 55 hydraulic cylinders 210, and in the 11 hydraulic cylinders 210 and 11 die-cushion pins 102 in contact with the piston rods of the 11 hydraulic cylinders 210, the hydraulic cylinders 210 and the die-cushion pins 102 marked with circles are the hydraulic cylinders 210 to be used for the shim thickness adjustment and the die-cushion pins 102 to be used, respectively.

First Embodiment of Shim Adjusting Device of Die-Cushion Device

Figure 3:
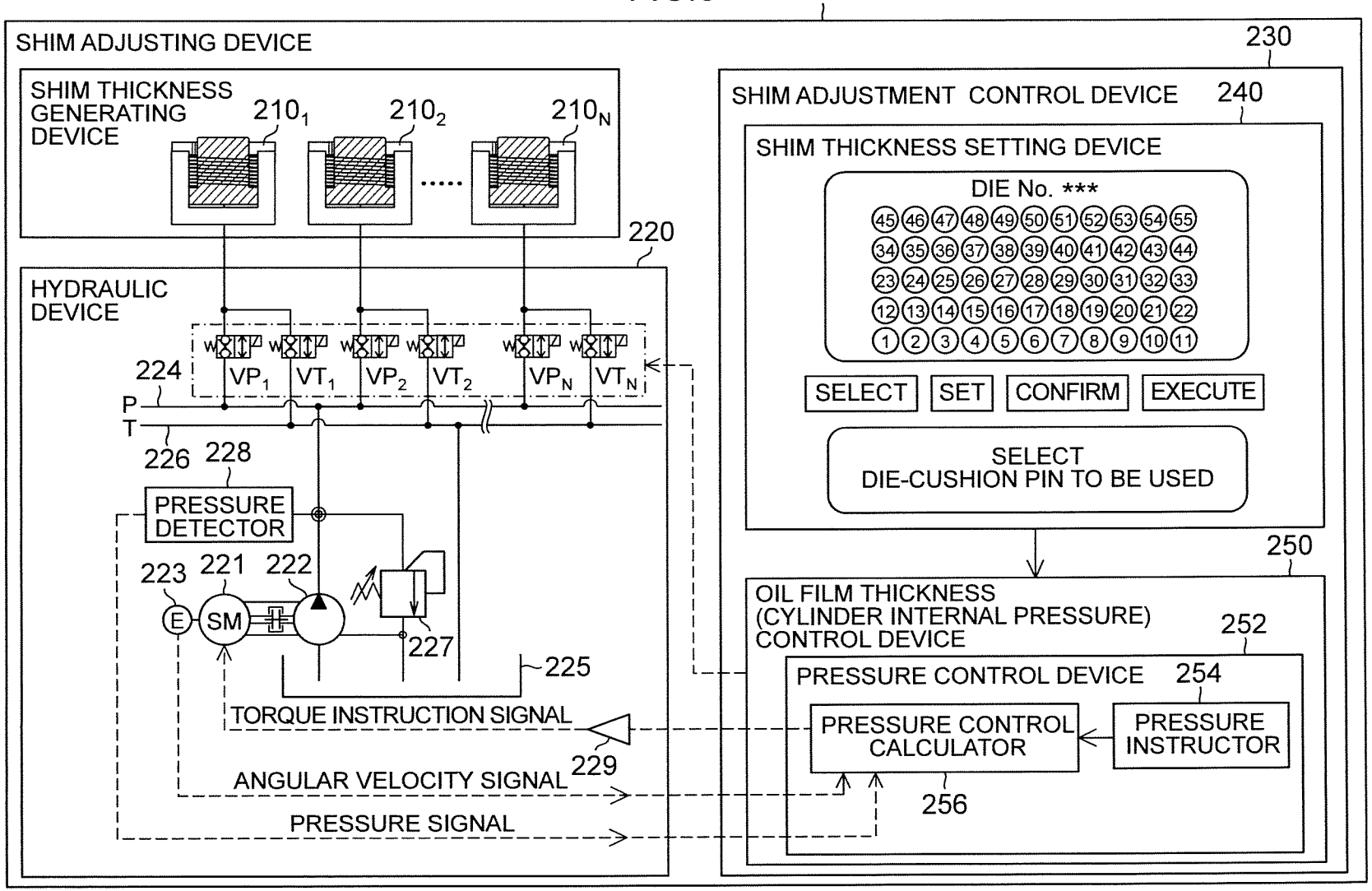
FIG. 3 is a block diagram of an essential part illustrating a first embodiment of the shim adjusting device of the die-cushion device according to the present invention.

FIG. 3 is a block diagram of an essential part illustrating the first embodiment of the shim adjusting device of the die-cushion device according to the present invention.

The shim adjusting device 200 of the first embodiment illustrated in FIG. 3 includes a plurality (55 pieces) of the hydraulic cylinders 210 ($\mathbf{210}_1$, $\mathbf{210}_2$, . . . $\mathbf{210}_{N=55}$) functioning as shim thickness generating devices, the hydraulic device 220 functioning as a fluid pressure device, and a shim adjustment control device 230.

Figure 4:
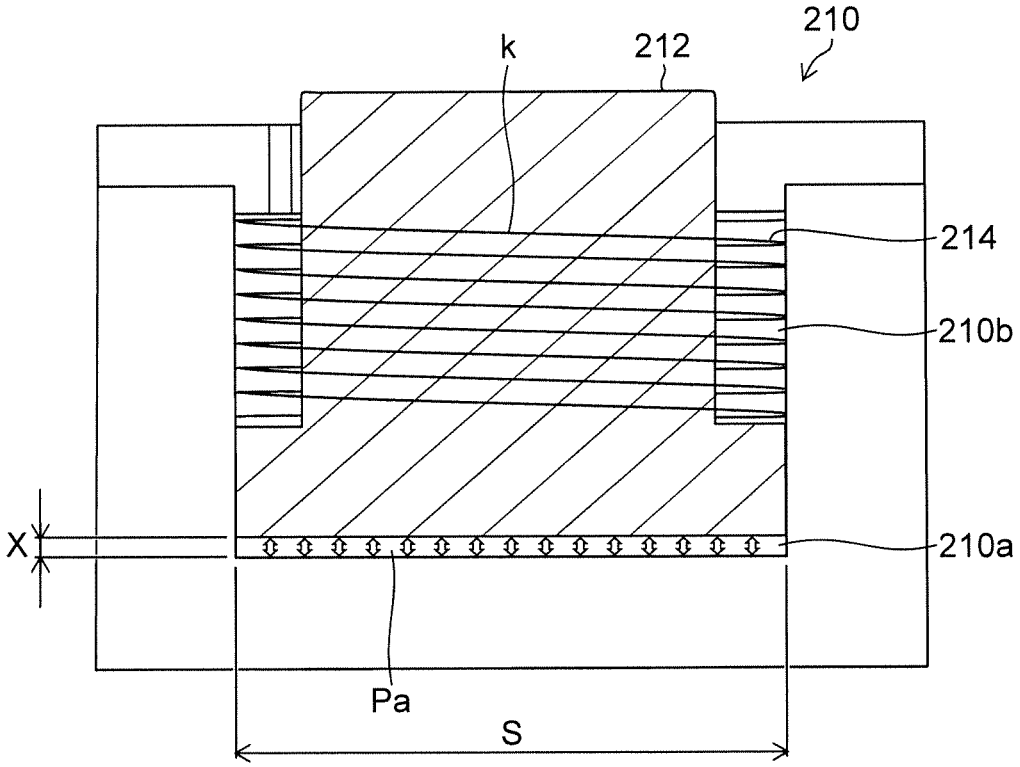
FIG. 4 is a longitudinal sectional view illustrating constitution of a hydraulic cylinder 210.

FIG. 4 is a longitudinal sectional view illustrating constitution of the hydraulic cylinder 210.

As illustrated in FIG. 4, the hydraulic cylinder 210 is a single-rod type hydraulic cylinder (single-rod type fluid pressure cylinder) having a single piston rod 212 and includes a spring 214 for urging the piston rod 212 in a lowering direction.

The spring 214 is preferably a disk spring disposed on a lowering-side pressurizing chamber 210*b* of the hydraulic cylinder 210. That is because the disk spring can be adjusted to a desired spring constant k by a method of combining (serial and/or parallel stacking of a plurality of) commercial disk springs.

To the rise-side pressurizing chamber 210*a* of each of the hydraulic cylinders 210, the operating oil (operating fluid) whose pressure is controlled can be supplied from the hydraulic device 220, respectively.

Here, a height direction position of the piston rod 212 of the hydraulic cylinder 210 can be adjusted by controlling the pressure of the operating oil to be supplied to the rise-side pressurizing chamber 210*a* of the hydraulic cylinder 210.

Here, assuming that a spring constant of the spring 214, a sectional area of the rise-side pressurizing chamber 210*a* of the hydraulic cylinder, an oil film thickness (shim thickness), a hydraulic pressure (pressure), and a preload are expressed by symbols below, the oil film thickness X can be expressed by [Equation 1]:

k: spring constant [kN/mm]

S: sectional area ($cm^2$) of rise-side pressurizing chamber 210*a* of hydraulic cylinder X: oil film thickness (shim thickness) [mm]

$P_a$: hydraulic pressure (MPa)

$F_o$: preload (kN)

$$X=(P_a \times S/10-F_o)/k \qquad \text{[Equation 1]}$$

where in the case of X<0, X=0 in [Equation 1].

Subsequently, the hydraulic device 220 will be described.

The hydraulic device 220 includes a hydraulic pump 222 driven by a servomotor 221 functioning as a hydraulic source (fluid pressure source), an encoder 223 which detects an angular velocity of the servomotor 221, a pressurization line 224 through which the operating oil is supplied from the hydraulic pump 222, a tank line 226 connected to a tank 225, a plurality of first solenoid valves VP ($VP_1$, $VP_2$, . . . $VP_{N=55}$) provided correspondingly to each of the hydraulic cylinders 210, a plurality of second solenoid valves VT ($VT_1$, $VT_2$, . . . $VT_{N=55}$), a relief valve 227, and a pressure detector 228 which detects the pressure of the pressurization line 224.

The plurality of first solenoid valves VP is disposed in each of lines connecting the rise-side pressurizing chamber 210*a* of each of the hydraulic cylinders 210 and the pressurization line 224, while the plurality of second solenoid valves VT is disposed in each of lines connecting the rise-side pressurizing chamber 210*a* of each of the hydraulic cylinders 210 and the tank line 226.

Moreover, the plurality of first solenoid valves VP and the plurality of second solenoid valves VT are non-leak type solenoid valves opened when a solenoid is excited (ON) and closed when the solenoid is demagnetized (OFF), respectively.

The plurality of first solenoid valves VP and the plurality of second solenoid valves VT are normally OFF but either one of the first solenoid valves VP and the second solenoid valves VT in the plurality of first solenoid valves VP and the plurality of second solenoid valves VT is turned ON/OFF by the shim adjustment control device 230 (oil film thickness control device 250) which will be described later. Then, one of the hydraulic cylinders 210 corresponding to the first solenoid valve VP and the second solenoid valve subjected to ON/OFF control becomes (is selected as) the hydraulic cylinder 210 as an adjustment target in the plurality of hydraulic cylinders 210.

The hydraulic device 220 supplies the operating oil with a required pressure to the rise-side pressurizing chamber 210*a* of the selected hydraulic cylinder 210 as the adjustment target and adjusts the height direction position (oil film thickness) of the piston rod 212 of the hydraulic cylinder 210.

When the oil film thickness of the hydraulic cylinder $\mathbf{210}_1$ is to be adjusted, for example, only the second solenoid valve $VT_1$ corresponding to the hydraulic cylinder $\mathbf{210}_1$ is turned ON by an ON/OFF control signal from the oil film thickness control device 250 to the first solenoid valve VP and the second solenoid valve VT, while the other first solenoid valves VP and second solenoid valves VT are turned OFF. In this case, the operating oil in the rise-side pressurizing chamber 210*a* of the hydraulic cylinder $\mathbf{210}_1$ is discharged to the tank 225 through the second solenoid valve VT1 and the tank line 226 by the preload (1 kN, for example) by the spring 214, whereby the oil film thickness becomes 0 mm.

Subsequently, after the second solenoid valve $VT_1$ is turned OFF by the oil film thickness control device 250, the first solenoid valve $VP_1$ is turned ON. As a result, a pressure oil subjected to the pressure control is supplied from the hydraulic pump 222 only to the hydraulic cylinder $\mathbf{210}_1$ through the pressurization line 224 and the first solenoid valve $VP_1$.

Here, the oil film thickness X of the operating oil supplied to the rise-side pressurizing chamber 210*a* of the hydraulic cylinder $\mathbf{210}_1$ can be adjusted by controlling the hydraulic pressure $P_a$ as indicated in [Equation 1].

The pressure detector 228 is to detect the pressure of the pressurization line 224 and outputs a pressure signal indicating the detected pressure to the oil film thickness control device 250 (a pressure control calculator 256 of the pressure control device 252) as a pressure feedback signal when the hydraulic pressure $P_a$ is controlled. Moreover, the encoder 223 outputs an angular velocity signal indicating an angular velocity of a drive shaft of the servomotor 221 to the pressure control calculator 256 as an angular velocity feedback signal for ensuring dynamic stability when the hydraulic pressure $P_a$ is controlled. Moreover, the relief valve 227 is provided as a device which operates at occurrence of an abnormal pressure (at occurrence of accidental abnormal pressure) so as to prevent breakage of the hydraulic equipment.

Subsequently, the shim adjustment control device 230 will be described.

The shim adjustment control device 230 includes the shim thickness setting device 240 and the oil film thickness control device 250.

Figure 5:
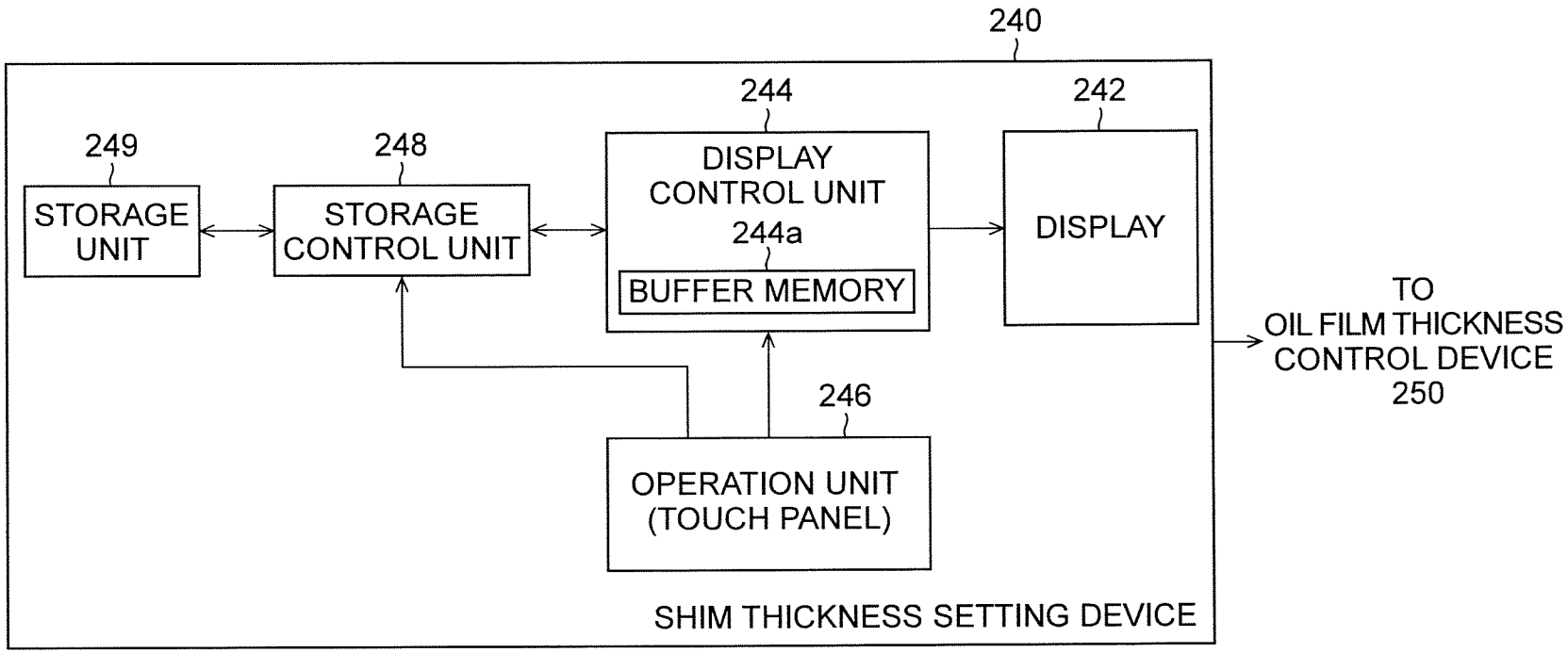
FIG. 5 is a block diagram illustrating constitution of a shim thickness setting device 240.

FIG. 5 is a block diagram illustrating constitution of the shim thickness setting device 240.

As illustrated in FIG. 5, the shim thickness setting device 240 includes a display 242 such as a liquid crystal display with a touch panel or the like, a display control unit 244 functioning as a first display control unit and a second display control unit, an operation unit 246 functioning as a first operation unit and a second operation unit, a storage control unit 248, and a storage unit 249.

Figure 8:
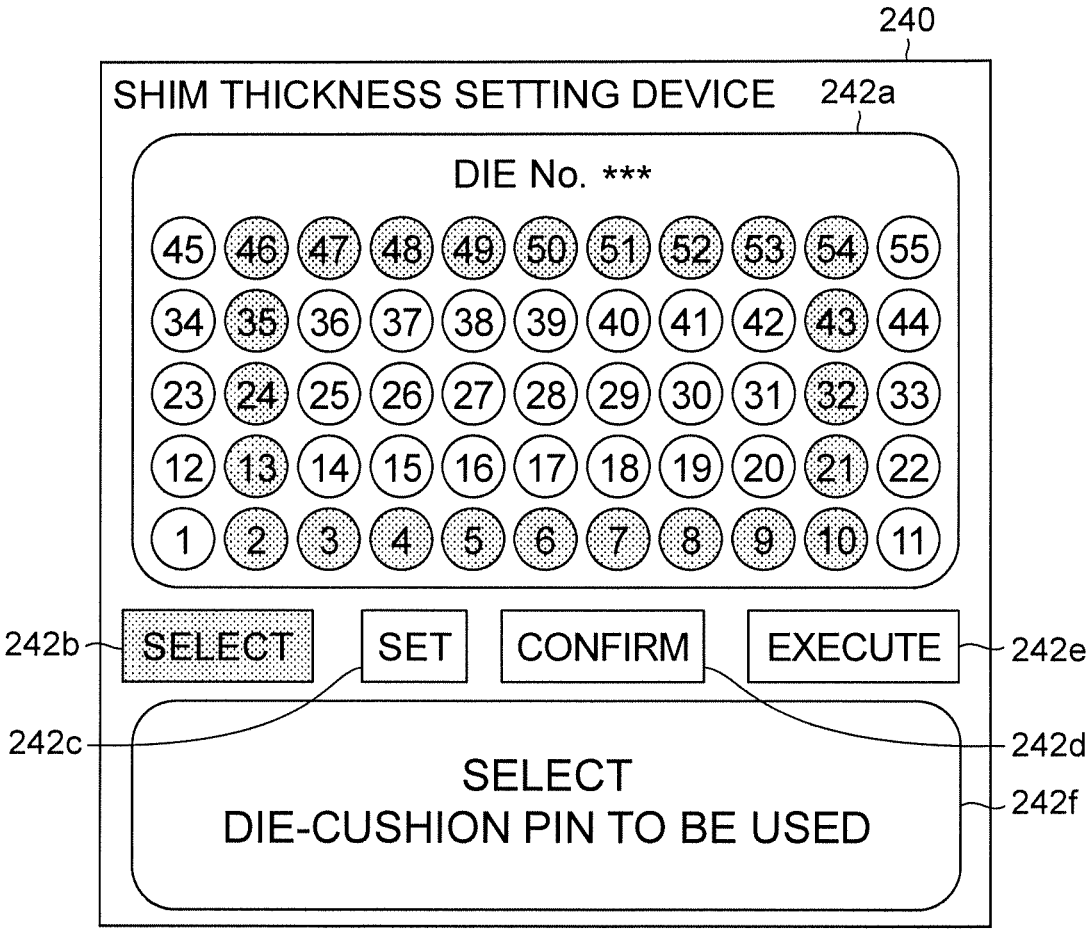
FIG. 8 is a diagram illustrating the shim thickness setting device 240 and particularly is a diagram illustrating an operation screen when a die-cushion pin to be used for actual wrinkle pressing in 55 die-cushion pins is to be selected.

The operation unit 246 includes various icon buttons (a set button 242*c*, a confirm button 242*d*, and an execute button 242*e* and the like illustrated in FIG. 8) of the touch panel provided on a display screen of the display 242, receives an input by a touch operation by the user, and outputs input information to the display control unit 244.

Here, the input information input by the operation unit 246 includes selection information of selecting the die-cushion pin 102 to be used for actual wrinkle pressing in the plurality of die-cushion pins 102, the shim thickness set value indicating the oil film thickness (shim thickness) of each of the selected die-cushion pins 102 to be used, information for editing the shim thickness set value, identification information (die No.) of the die indicating the die (the upper die 14, the lower die 15) set on the press machine 10 and the like.

The display control unit 244 generates an image for display corresponding to the input information based on various types of the input information input from the operation unit 246, outputs the generated image for display to the display 242 and temporarily holds the input information (selection information of use/non-use of each of the die-cushion pins and the shim thickness set value of each of the die-cushion pins to be used) in a buffer memory 244*a*.

On the display 242, a screen 242*a* illustrating a layout (pin layout) illustrating a layout of the 55 (=11×5) die-cushion pins 102 and the like as illustrated in FIGS. 8 to 11, 14, and 15 and the like which will be described later, a select button 242*b*, the set button 242*c*, the confirm button 242*d*, and the execute button 242*e* which are icon buttons functioning as a part of the operation unit 246, and a screen 242*f* displaying a message supporting a shim thickness setting operation are displayed based on an image for display input from the display control unit 244.

The selection information of use/non-use of each of the die-cushion pins and the shim thickness set value of each of the die-cushion pins to be used set by the shim thickness setting device 240 and temporarily stored in the buffer memory 244*a* are output to the oil film thickness control device 250.

As described above, the shim thickness setting device 240 includes a function as a die-cushion pin selector which selects the die-cushion pin to be used in the plurality of die-cushion pins 102 inserted into the plurality of C-holes formed in the bolster 13 and a function as a shim thickness setter which sets a plurality of shim thickness set values corresponding to the plurality of die-cushion pins to be used selected by the die-cushion pin selector which are arbitrary shim thickness set values for the die-cushion pins to be used, respectively.

The storage unit 249 is to store at least the shim thickness set value of each of the die-cushion pins to be used in association with the die (die No.) to be used in the press machine 10 and in this embodiment, information (that is, the selection information of use/non-use of each of the die-cushion pins) indicating the die-cushion pin to be used for the shim adjustment (use "1") and the die-cushion pin not to be used (non-use "0") in the plurality of die-cushion pins to be inserted into the plurality of C-holes (C1 to C55: identification information of the C-hole) formed in the bolster 13 for each of the die No. as illustrated in FIG. 17 and the shim thickness set value of each of the plurality of die-cushion pins to be inserted into the plurality of C-holes (C1 to C55) formed in the bolster 13 for each of the die No. as illustrated in FIG. 18 are stored.

The oil film thickness (shim thickness) is adjusted for each of the die-cushion pins to be used at least by the shim thickness set value of each of the die-cushion pins to be used set as appropriate by the shim thickness setting device 240 and then, by referring to the forming result of the formed product by trial (forming trial), the shim thickness set value of each of the die-cushion pins to be used is re-set (modified). Then, when a storage instruction is input from the operation unit 246 functioning as a storage operation unit, the storage control unit 248 obtains the shim thickness set value of each of the die-cushion pins to be used which is used when a quality product was formed from the buffer memory 244*a* and has it stored in association with the die used for the forming trial in the storage unit 249.

On the other hand, if the shim thickness set value of each of the die-cushion pins to be used corresponding to the die (die No.) set on the press machine 10 is stored in the storage unit 249, when the read-out instruction is input from the operation unit 246 functioning as the storage operation unit, the storage control unit 248 reads out the shim thickness set value of each of the die-cushion pins to be used stored in association with the die set on the press machine 10 from the storage unit 249 and outputs it to the display control unit 244 (temporarily stored in the buffer memory 244*a*).

As a result, when the die having experienced the shim adjustment by the shim adjusting device 200 is set on the press machine 10, the shim adjustment can be automatically performed. Moreover, though replacement of the die in the press machine 10 can be performed by an automatic die replacing device, as a part of automatic die replacement sequence control of the automatic die replacing device by obtaining the die No. of the die when (after) the die is carried in during automatic die replacement, the shim adjustment can be automatically performed for the die after the replacement as a part of automatic die replacement sequence control by obtaining the die No. of the die when (after) the die is carried in during automatic die replacement.

The storage unit 249 can store the shim thickness set values corresponding to 100 to 400 dies. Moreover, the storage unit 249 is not limited to that provided in the shim adjusting device 200 (shim thickness setting device 240), but a storage unit (data bank) provided in a PLC (Programmable Logic Controller) in the press machine 10 or the die-cushion device 100, for example, can be used.

Returning to FIG. 3, the oil film thickness control device 250 is to control the oil film thickness (shim thickness) by controlling the pressure of the rise-side pressurizing chamber 210*a* of each of the hydraulic cylinders 210 and includes the pressure control device 252.

The oil film thickness control device 250 inputs the selection information of use/non-use of each of the die-cushion pins and the shim thickness set value of each of the die-cushion pins to be used from the shim thickness setting device 240 as described above and performs the adjustment of the oil film thickness (shim adjustment) sequentially one by one for all the die-cushion pins 102 based on the input information. The oil film thickness control device 250 enables adjustment of the oil film thickness X of the operating oil in the rise-side pressurizing chamber 210*a* of the hydraulic cylinder 210 corresponding to the one die-cushion pin 102 as an adjustment target by controlling ON/OFF of the first solenoid valve VP and the second solenoid valve VT as described above and calculates the pressure instruction corresponding to the oil film thickness X based on [Equation 1] from the oil film thickness X (that is, the shim thickness set value) to be adjusted.

The pressure control device 252 includes the pressure instructor 254 and the pressure control calculator 256. In the pressure instructor 254, a pressure instruction calculated for each of the die-cushion pins as adjustment targets is set by the oil film thickness control device 250, and the pressure instructor 254 outputs the set pressure instruction to the pressure control calculator 256.

To the other inputs of the pressure control calculator 256, a pressure signal indicating the pressure of the pressurization line 224 detected by the pressure detector 228 and an angular velocity signal indicating an angular velocity of the drive shaft of the servomotor 221 detected by the encoder 223 are added, and the pressure control calculator 256 calculates a torque instruction signal for controlling a torque of the servomotor 221 based on the pressure instruction input from the pressure instructor 254 and the pressure signal input from the pressure detector 228. This calculated torque instruction signal is output to the servomotor 221 through a servo amplifier 229, and the drive torque of the servomotor 221 is controlled so that the pressure of the operating oil ejected from the hydraulic pump 222 driven by the servomotor 221 (that is, the pressure detected by the pressure detector 228) becomes a pressure corresponding to the pressure instruction. The angular velocity signal input from the encoder 223 which detects the angular velocities of the drive shaft of the servomotor 221, respectively, is used for compensation for stably controlling the pressure of the operating oil.

When the pressure of the operating oil ejected from the hydraulic pump 222 is controlled by the pressure control device 252 as above, the hydraulic pressure $P_a$ of the operation oil supplied from the hydraulic pump 222 to the rise-side pressurizing chamber 210*a* of the hydraulic cylinder 210 as an adjustment target through the pressurization line 224 and the first solenoid valve VP becomes the pressure corresponding to the pressure instruction, and the oil film thickness X (shim thickness) of the rise-side pressurizing chamber 210*a* of the hydraulic cylinder is adjusted to the shim thickness set value.

When the oil film thickness control of the hydraulic cylinder 210 as an adjustment target is finished, the first solenoid valve VP corresponding to the hydraulic cylinder 210 as an adjustment target is turned OFF, and the height direction position (oil film thickness) of the piston rod 212 of the hydraulic cylinder 210 is held.

The adjustment of the oil film thickness (shim adjustment) is performed by performing the oil film thickness control described above by sequentially switching the hydraulic cylinder 210 as an adjustment target.

Shim Adjustment

Subsequently, the shim adjustment using the shim adjusting device 200 with the constitution above will be described.

The die used in this embodiment (the upper die 14 and the lower die 15 illustrated in FIG. 1) is to draw a square tube product having a rectangular section from a laterally long material (blank) 20. In this embodiment, initial setting of a die to be used for the first time is assumed.

Figure 6:
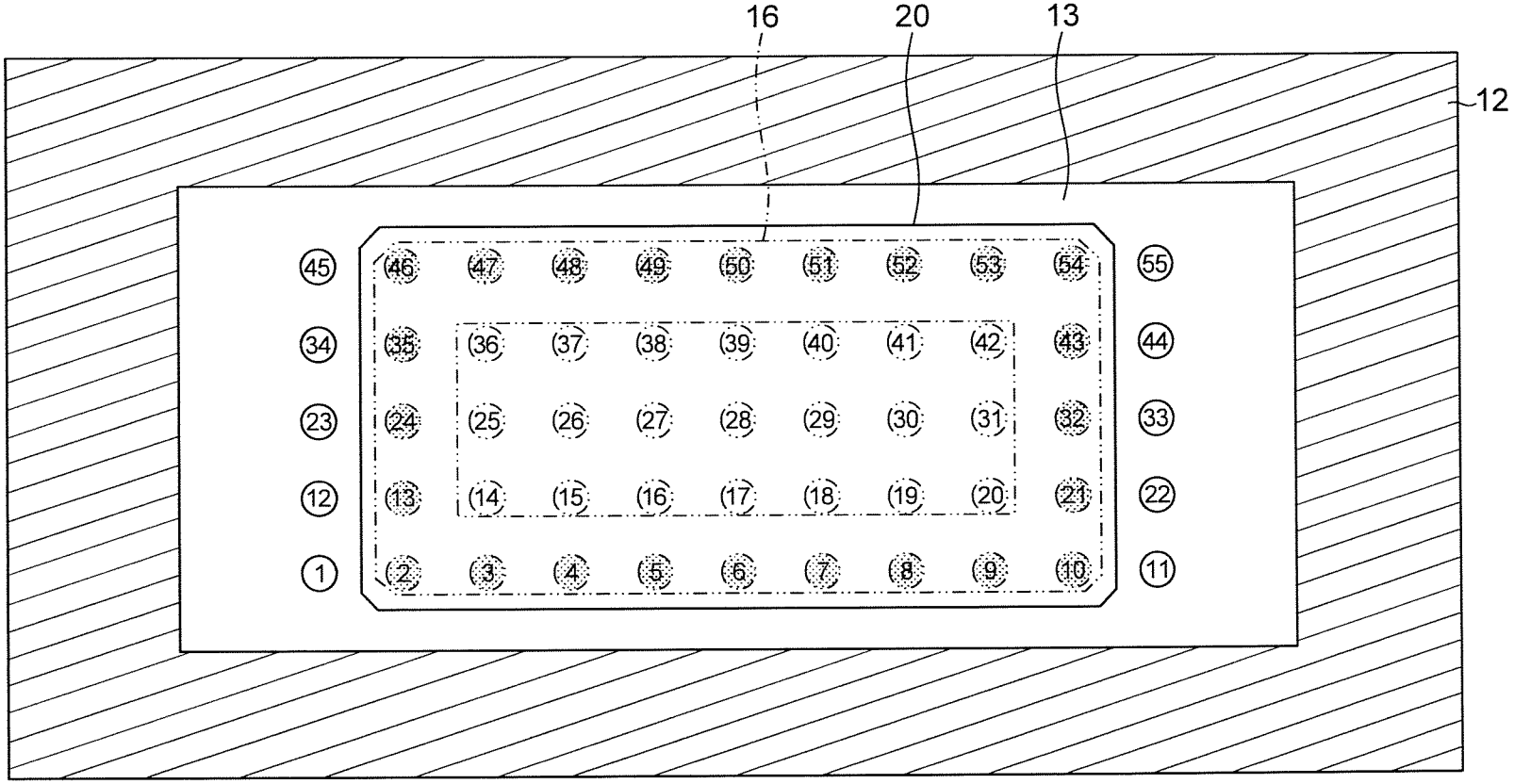
FIG. 6 is a plan view of an essential part of the die-cushion device 100 seen from a direction of an arrow 6 in FIG. 1.

FIG. 6 is a plan view of an essential part of the die-cushion device 100 seen from the direction of the arrow 6 illustrated in FIG. 1.

In FIG. 6, the C-holes are formed at 55 spots indicated by No. 1 to No. 55 in the bolster 13, and the die-cushion pin (55 die-cushion pins in total) is inserted usably in each of the C-holes.

When this die is to be used, the 24 die-cushion pins No. 2 to No. 10, No. 13, No. 21, No. 24, No. 32, No. 35, No. 43, No. 46 to No. 54 indicated by two-dot chain line circles painted in gray and located at portions pressing the blank holder 16 (functioning as wrinkle presser) in the 55 die-cushion pins are the die-cushion pins to be used for transmitting the die-cushion force to the blank holder 16, and the die-cushion pins indicated by solid-line circles and the other die-cushion pins indicated by outlined two-dot chain-line circles are in a state inserted in the blank holder 16 and do not function as the wrinkle pressers.

Figure 7A:
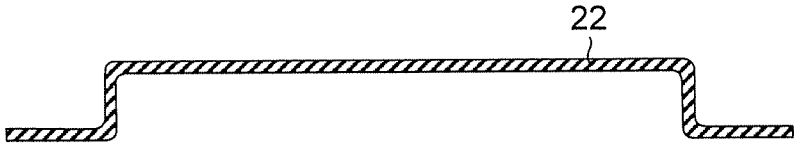
FIG. 7A and FIG. 7B are respectively a sectional view and a plan view of a formed product 22 when the shim adjusting device 200 is not made to function.
Figure 7B:
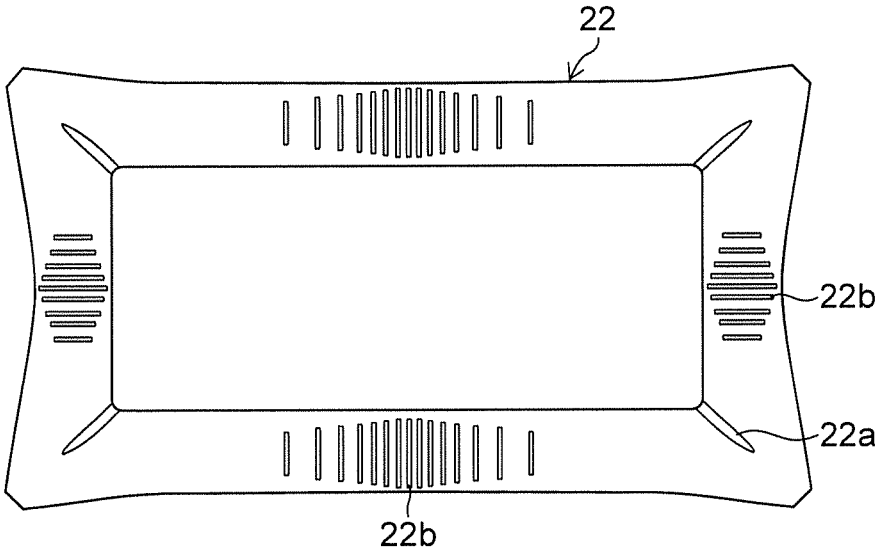

FIGS. 7A and 7B are a sectional view and a plan view of the formed product 22 when the shim adjusting device 200 is not made to function.

Figure 13A:
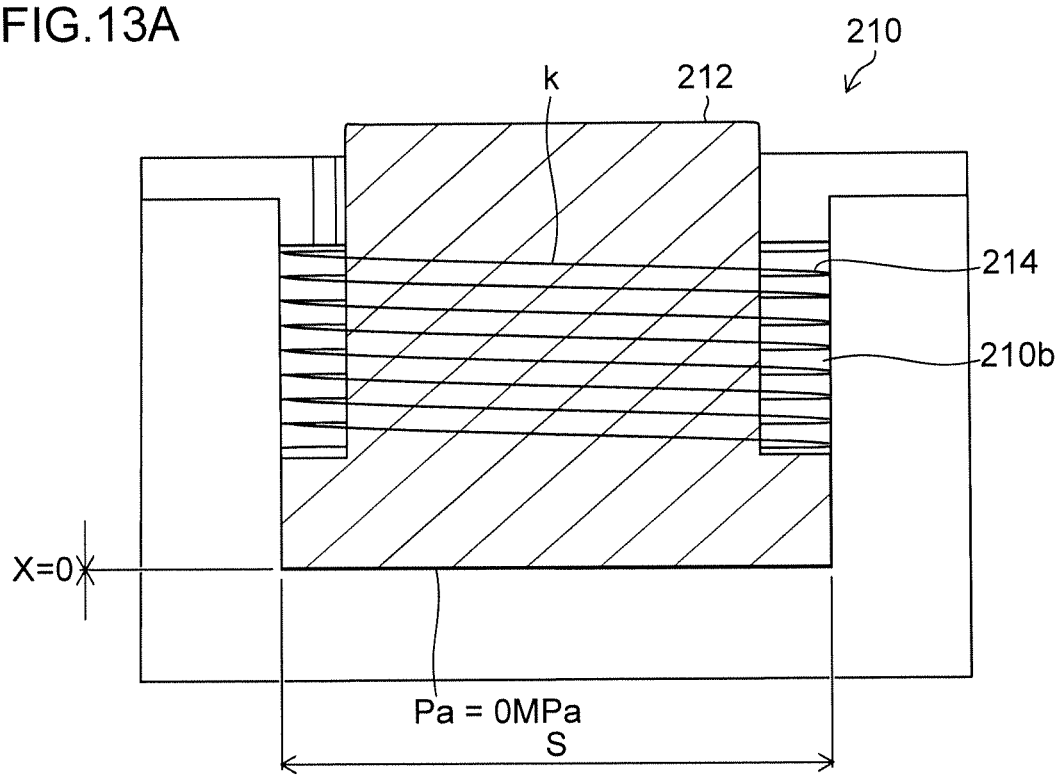
FIGS. 13A and 13B are respectively diagrams illustrating the hydraulic cylinder 210 when an oil film thickness X of a rise-side pressurizing chamber 210*a* of the hydraulic cylinder 210 is 0 mm and 0.5 mm, respectively.

When the shim adjusting device 200 is not made to function, the hydraulic pressure does not act on the rise-side pressurizing chamber of the hydraulic cylinder 210 as illustrated in FIG. 13A, and the piston rod 212 is pressed by the spring 214 and is located at a lowermost limit. Therefore, each of the hydraulic cylinders 210 is in a state where the oil film thickness is not formed (a state of oil film thickness X=0).

When the shim adjusting device 200 is not made to function (or in the case where the shim adjusting device 200 is not attached to the die-cushion device and when the shim adjustment of each of the die-cushion pins is not performed), the acting die-cushion force basically uniformly (in a distributed manner) acts between each of the die-cushion pins in such square-tube drawing. As a result, the wrinkle pressing function acts more strongly on a corner part of the formed product 22 at which the material basically flows not easily (originally), and a crack 22*a* is generated (more easily). The wrinkle pressing function acts more weakly on a center part between the corner parts at front and rear as well as right and left (particularly having a longer distance) of the formed product 22 at which the material flows easily (originally and) basically, a drawing wrinkle 22*b* is generated (more easily).

Thus, the shim adjusting device 200 is made to function so as to individually control the oil film thickness of each of the hydraulic cylinders 210 and to perform the shim adjustment.

FIGS. 8 to 11 are diagrams illustrating the shim thickness setting device 240, respectively, and are particularly transition diagrams of the screen (operation screen and the like) of the shim thickness setting device 240 (display 242) when the shim thickness is set.

FIG. 8 illustrates an operation screen when the die-cushion pin to be used for actual wrinkle pressing in the 55 die-cushion pins is to be selected. As illustrated in FIG. 8, on the screen 242*a* of the shim thickness setting device 240, a pin layout (first layout) illustrating a layout of the 55 die-cushion pins, the die Nos. and the like are displayed, and on the screen 242*f* of the shim thickness setting device 240, a message that "Select die-cushion pin to be used" is displayed.

The user presses (touches) the select button 242*b* receiving the operation of selecting the die-cushion pin on the operation screen of the shim thickness setting device 240 and then, touches a position number of the die-cushion pin to be used in the first layout of the 55 die-cushion pins displayed on the screen 242*a* and selects the die-cushion pin to be used. In the first layout displayed on the screen 242*a*, a pin layout (second layout) illustrating a layout of the die-cushion pin to be used selected by the touch is displayed capable of being discriminated from the first layout including the die-cushion pins not in use.

Figure 9:
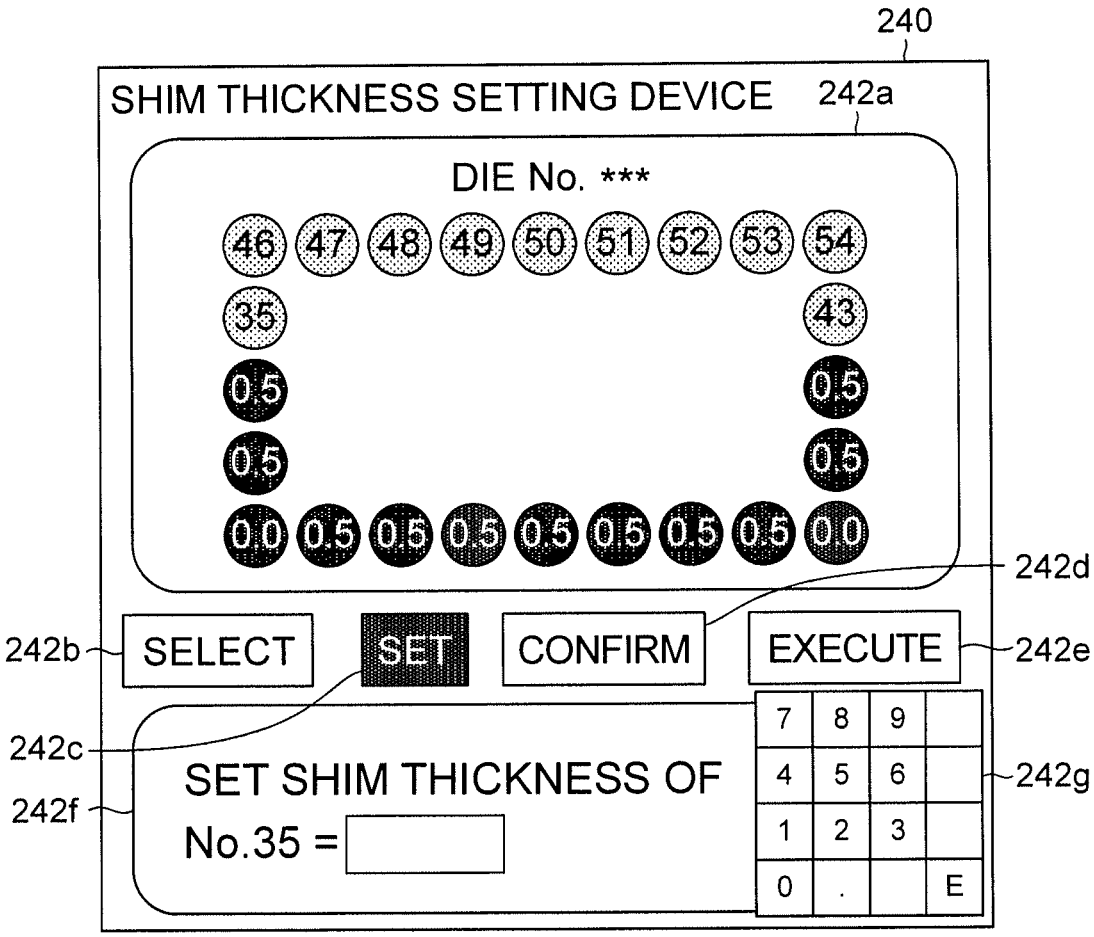
FIG. 9 is a diagram illustrating the shim thickness setting device 240 and particularly is a diagram illustrating the operation screen in which a shim thickness is set for the selected die-cushion pin to be used.

FIG. 9 illustrates the operation screen for setting the shim thickness for the selected die-cushion pin to be used. As illustrated in FIG. 9, on the screen 242*a* of the shim thickness setting device 240, the second layout of the 24 selected die-cushion pins to be used is displayed, and on the screen 242*f* of the shim thickness setting device 240, a message that "Set shim thickness of No. 35=" " " and a ten key 242*g* are displayed.

The user presses the set button 242*c* for setting the shim thickness on the operation screen of the shim thickness setting device 240 and sequentially (in the order of the die-cushion pin position numbers) inputs (sets) the shim thickness for the selected die-cushion to be used by the ten key 242*g*.

In this embodiment, the shim thickness set values at the die-cushion pin positions at four corner parts are set to 0 mm and the other shim thickness set values to 0.5 mm.

FIG. 9 illustrates a state where the setting of the shim thicknesses of 13 die-cushion pins to be used in the 24 die-cushion pins to be used has been completed. Moreover, if the same shim thickness is to be set, a collective cushion pin position number range can be specified so that the shim thickness is set collectively (at once).

Figure 10:
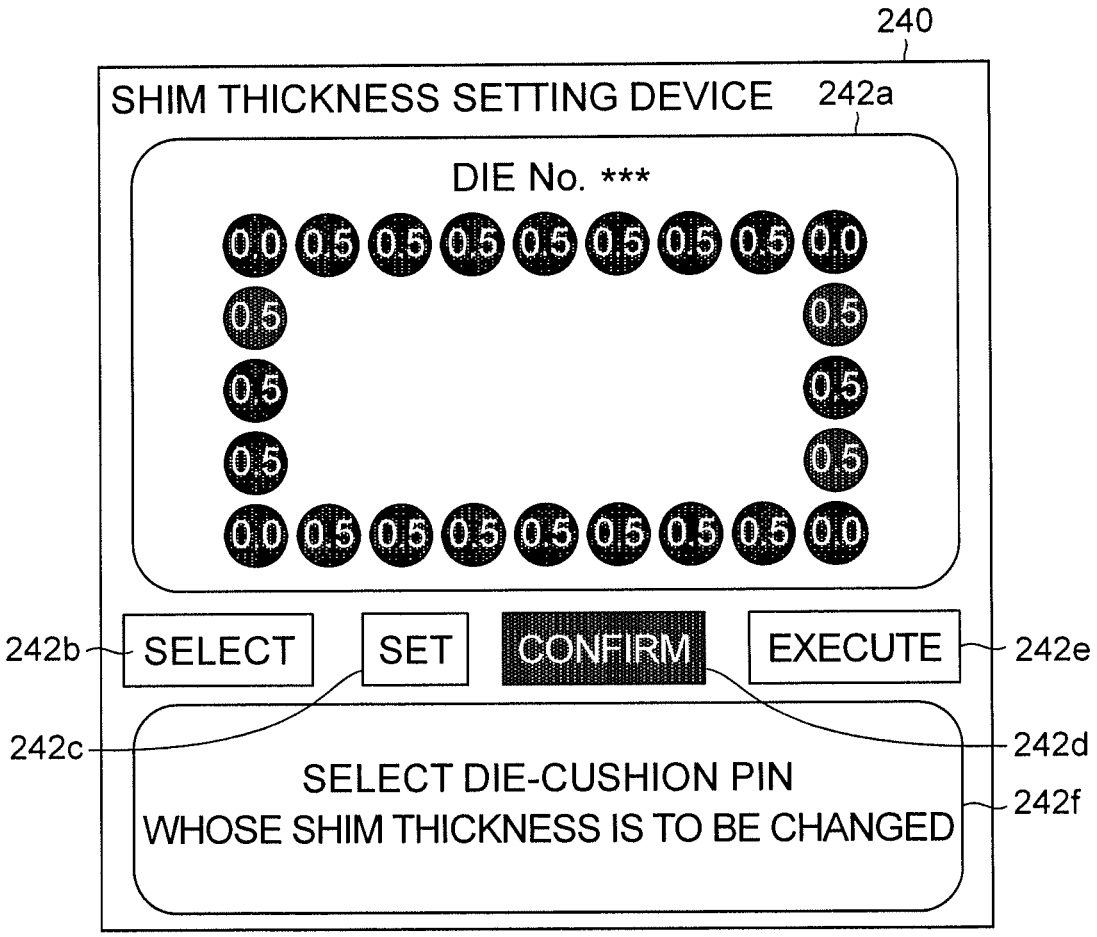
FIG. 10 is a diagram illustrating the shim thickness setting device 240 and particularly is a diagram illustrating the operation screen in which a shim thickness set value is checked and the shim thickness set value of the die-cushion pin is partially changed in all the selected die-cushion pins to be used.

FIG. 10 illustrates the operation screen in which the shim thickness set value is confirmed and the shim thickness set value of the die-cushion pin is partially changed in all the selected die-cushion pins to be used.

As illustrated in FIG. 10, on the screen 242*a* of the shim thickness setting device 240, a pin layout of the 24 die-cushion pins to be used are displayed, and the shim thickness set value is displayed on a pin display portion of each of the die-cushion pins. Moreover, on the screen 242*f* of the shim thickness setting device 240, a message that "Select die-cushion pin whose shim thickness is to be changed" is displayed.

The user presses the confirm button 242*d* for confirming the shim thickness set value on the operation screen of the shim thickness setting device 240 and causes the set shim thickness set value to be listed/displayed with respect to all the selected die-cushion pins to be used.

Then, when the set shim thickness set value is to be partially changed, the user touches the pin display portion to be changed on the operation screen and changes the shim thickness set value by re-input. In this embodiment, since the confirm button 242*d* also functions as a change button for changing the shim thickness set value, the change button is not provided, but the change button may be provided separately.

Figure 11:
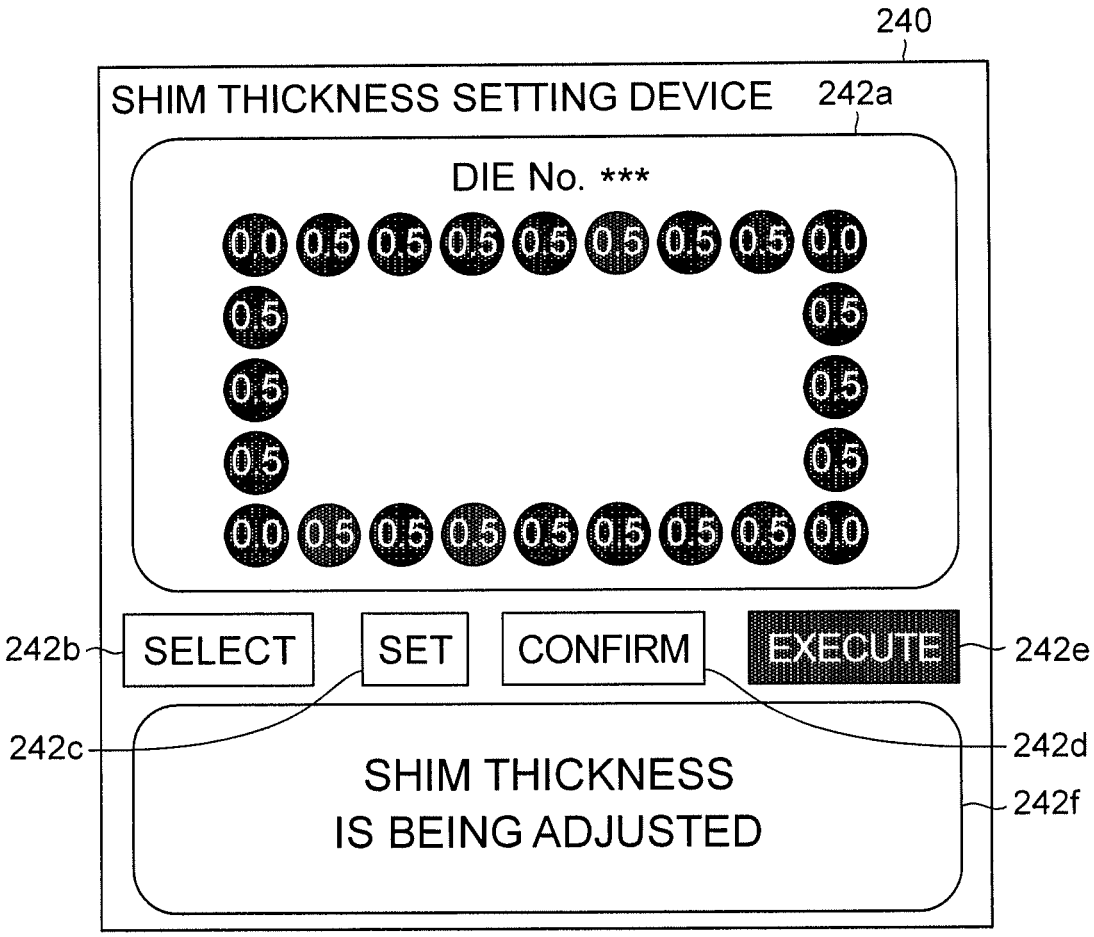
FIG. 11 is a diagram illustrating the shim thickness setting device 240 and particularly is a diagram illustrating the operation screen when shim thickness setting is performed to the selected die-cushion pin to be used.

FIG. 11 illustrates the operation screen when the shim thickness setting is being executed for the selected die-cushion pin to be used.

The user presses the execute button 242*e* of the shim adjustment on the operation screen of the shim thickness setting device 240 and executes the shim thickness adjustment based on the set shim thickness set value for all the selected die-cushion pins to be used.

In this case, on the screen 242*f* of the shim thickness setting device 240, a message that "Shim thickness is being adjusted" is displayed. Moreover, the shim thickness setting device 240 outputs the selection information of use/non-use of the each of the die-cushion pins and the shim thickness set value of each of the set die-cushion pins to be used to the oil film thickness control device 250.

According to the shim thickness setting device 240 of this embodiment, by operating the operation unit 246 (by touching the touch panel) in a dialogue manner while checking the operation screen of the shim thickness setting device 240, the shim thickness set value of each of the die-cushion pins to be used can be set.

The oil film thickness control device 250 executes adjustment of the oil film thickness (shim adjustment) one by one in the order for all the die-cushion pins 102 as described above based on the shim thickness set value of each of the die-cushion pins to be used set by the shim thickness setting device 240.

The spring 214 disposed in the lowering-side pressurizing chamber of the hydraulic cylinder 210 in this embodiment has the (relatively weak) spring constant k (=3.66 [kN/mm]) by combining a plurality of the disk springs, and a sectional area S of the rise-side pressurizing chamber 210*a* of the hydraulic cylinder 210 is 28.27 [$cm^2$].

As illustrated in FIG. 13A, when the oil film thickness X of the rise-side pressurizing chamber 210*a* of the hydraulic cylinder 210 is 0 mm, the preload of 1 kN is made to act by compressing the spring 214 by approximately 0.27 mm so that a stable shim thickness amount "0" is ensured. The hydraulic pressure $P_a$ at this time is a pressure when it is open to the tank 225 through the tank line 226 and it is 0 Pa (atmospheric pressure).

Figure 13B:
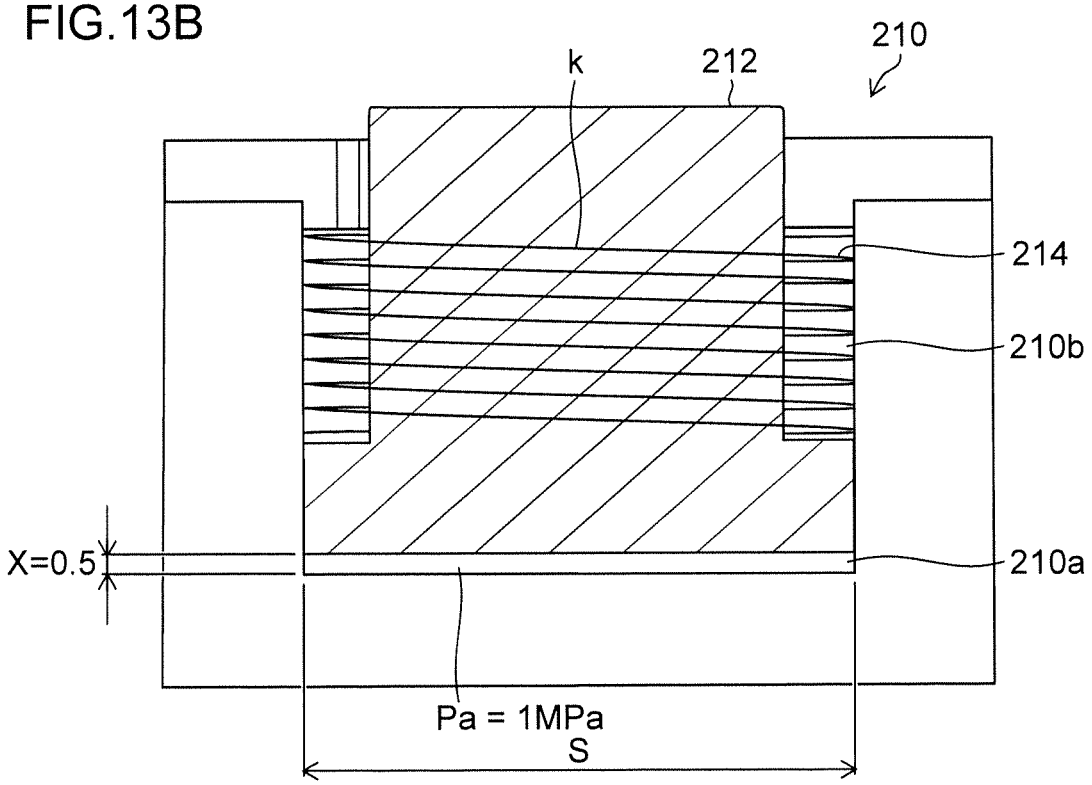

On the other hand, as illustrated in FIG. 13B, when the shim thickness set value (oil film thickness X) is 0.5 mm, the hydraulic pressure $P_a$ made to act on the rise-side pressurizing chamber 210*a* of the hydraulic cylinder 210 before the die-cushion action is I MPa. This hydraulic pressure $P_a$ (=1 MPa) can be calculated by substituting the oil film thickness X (=0.5 mm), the sectional area S (=28.27 $cm^2$), the preload Fo (=1 kN), and the spring constant (=3.66 [kN/mm]) in [Equation 1].

Then, by executing control by the oil film thickness control device 250 and the hydraulic device 220 so that the hydraulic pressure of the rise-side pressurizing chamber 210*a* of the hydraulic cylinder 210 becomes 1 MPa, the piston rod 212 of the hydraulic cylinder 210 rises to a position where the preload is offset and moreover, the spring 214 is compressed by 0.5 mm (that is, a position where the force for raising the piston rod 212 by the hydraulic pressure at 1 MPa and the urging force by the spring 214 compressed with the rise of the piston rod 212 are balanced) and stops.

Here, the reason why the spring 214 is constituted relatively weakly is to improve sensitivity of adjustment of the oil film thickness generated in the rise-side pressurizing chamber 210*a* with respect to the pressure of the operating oil made to act on the rise-side pressurizing chamber 210*a* of the hydraulic cylinder 210.

When the displacement constant $K_{P/X}$ indicated in the following equation is defined by the displacement amount X [mm] of the height position of the piston rod 212 with respect to the pressure P (MPa) of the operating oil acting on the rise-side pressurizing chamber 210*a* of the hydraulic cylinder 210, the displacement constant $K_{P/X}$ is preferably within a range of $K_{P/X}$=0.3 [MPa/mm] to 30 [MPa/mm]:

$$K_{P/X}=10\times k/S \qquad \text{[Equation 2]}$$

In this embodiment, the displacement constant $K_{P/X}$ is a value obtained by multiplying 10 in order to match a unit with that of a value obtained by dividing the spring constant k (3.66 [kN/mm]) by the rise-side pressurizing chamber sectional area S of the hydraulic cylinder (28.27 [mm]) and it is approximately 1.295 [MPa/mm] from [Equation 1].

When the shim adjusting device 200 is operated as above, and the shim adjustment for all the die-cushion pins 102 is finished, the user allows the press machine 10 to function and performs a first forming trial (trial).

In the first forming trial, the shim thickness of the die-cushion pin to be used at the four corner parts is adjusted to 0 mm as illustrated in FIG. 10 and the like, and the shim thicknesses of the other die-cushion pins to be used are adjusted to 0.5 mm.

Figure 12A:
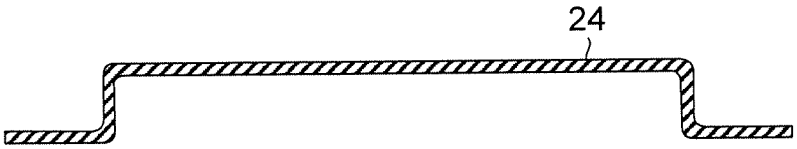
FIGS. 12A and 12B are respectively a sectional view and a plan view of a formed product 24 by a first forming trial in which the shim adjusting device 200 is made to function, respectively.
Figure 12B:
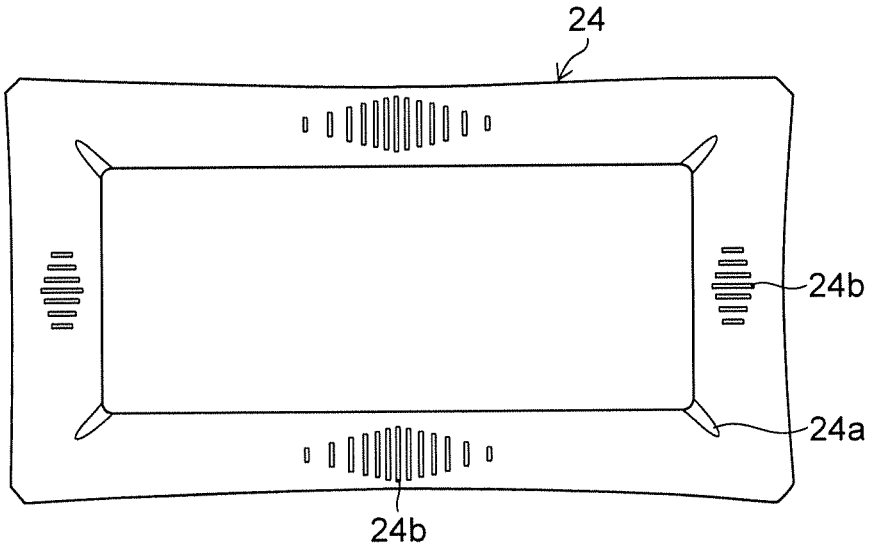

FIGS. 12A and 12B are respectively a sectional view and a plan view of the formed product 24 by the first forming trial when the shim adjusting device 200 is made to function.

As illustrated in FIG. 12B, a shape of the formed product 24 still shows a tendency of similarity to a shape of the formed product 22 (FIG. 7) when the shim adjusting device 200 is not made to function, but a dimension of the crack 24*a* at the corner part of the formed product 24 in which the material does not flow easily is contracted, and drawing wrinkles 24*b* at the center part between the corner parts of the front and rear as well as right and left (particularly having a longer distance) in the formed product 24 at which the material can flow easily are reduced.

<Verification of Shim Thickness Maintaining Performance of Shim Thickness Generating Device>

Subsequently, shim thickness maintaining performances of the hydraulic cylinder 210 functioning as the shim thickness generating device when the die-cushion is acting will be described.

In this embodiment, the die-cushion force when the die-cushion is acting is 1200 kN. Since the number of the die-cushion pins 102 to be used is 24, approximately 50 kN acts on a single die-cushion pin. On the 20 die-cushion pins whose shim thicknesses are adjusted to 0.5 mm, a die-cushion force larger than that on the four die-cushion pins whose shim thicknesses are adjusted to 0 mm acts, but for facilitation of the explanation, it is assumed below that 50 kN acts on a single die-cushion pin whose shim thickness is adjusted to 0.5 mm.

Therefore, assuming that a pressure generated in the rise-side pressurizing chamber 210*a* of the hydraulic cylinder 210 in press forming is $P_a'$, it is 17.69 MPa (=(50/28.7)×10).

On the other hand, since the hydraulic pressure (1 MPa in this embodiment) corresponding to the shim thickness has acted in advance on the hydraulic cylinder 210 whose shim thickness was adjusted to 0.5 mm as described above, assuming that a pressure change of the rise-side pressurizing chamber 210*a* of the hydraulic cylinder 210 before and after the press forming is $\Delta P_a$, the pressure change $\Delta P_a$ is $\Delta P_a=P_a'-P_a=17.69-1=16.69$ MPa.

At this time, a capacity of the rise-side pressurizing chamber 210*a* of the hydraulic cylinder 210 in proportion to the oil film thickness (shim thickness) is compressed by the portion of the pressure change $\Delta P_a$ (boost) and is contracted. Here, assuming that a modulus of elasticity K of volume of the operating oil is 1200 (MPa) and a contraction amount is ΔX [mm], the contraction amount ΔX is approximately 0.007 mm as indicated in the following equation:

$$\Delta X=(\Delta P_a/K)\times X=(16.69/1200)\times 0.5\approx 0.007 \text{ [mm]} \qquad \text{[Equation 3]}$$

In the end, the oil film thickness (shim thickness) during forming (after contraction) is 0.493 (=0.5−0.007) mm, and 0.5 mm set at the beginning is substantially maintained.

From the result of the formed product 24 by the first forming trial illustrated in FIG. 12, the shim thickness set value set in the first forming trial is partially changed (modified) in order to further improve the formed product (suppressing a crack and a drawing wrinkle of the formed product).

Figure 14:
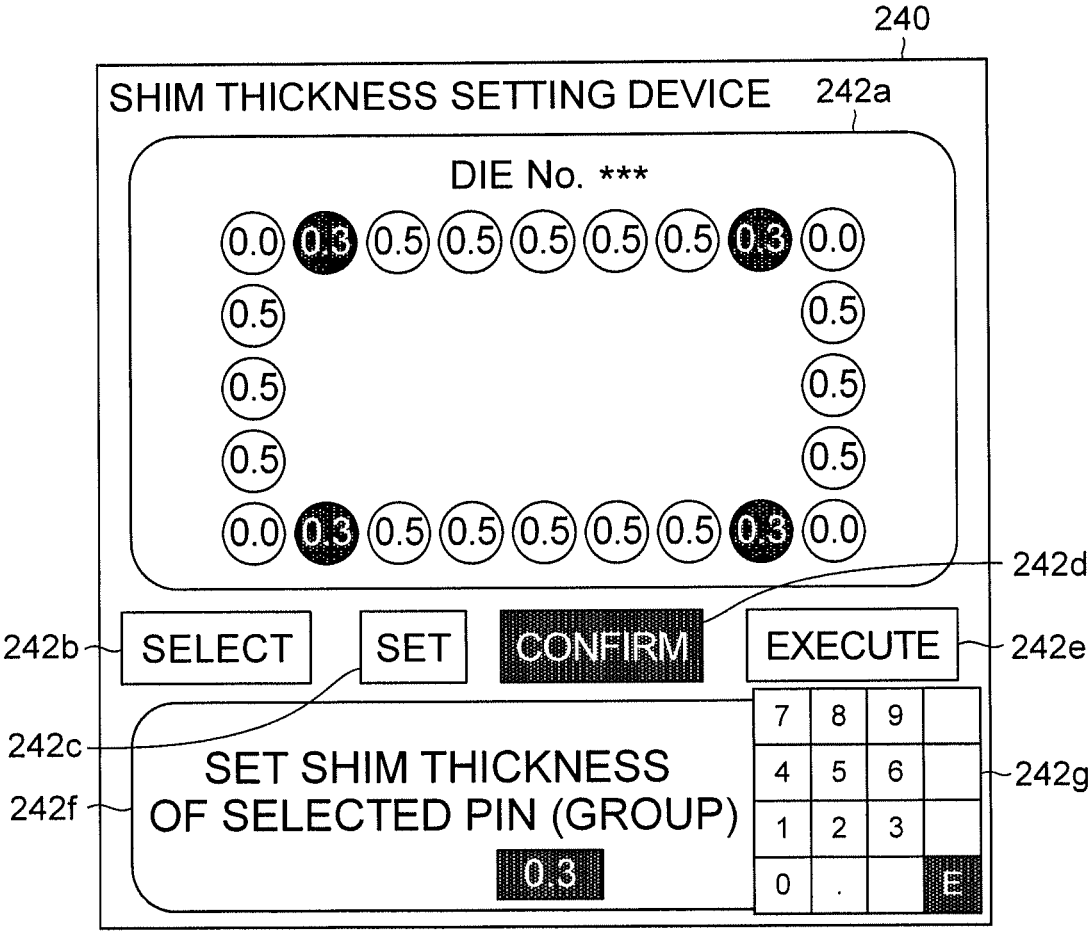
FIG. 14 is a diagram illustrating the shim thickness setting device 240 and particularly is a diagram illustrating a changed state of the shim thickness set value.

FIG. 14 is a diagram illustrating the operation screen of the shim thickness setting device 240 and particularly illustrates a state where the shim thickness set value is changed.

The user presses the confirm button 242*d* for confirming the shim thickness set value on the operation screen of the shim thickness setting device 240 and causes the shim thickness set values set at present to be listed/displayed for all the selected die-cushion pins to be used.

Subsequently, the user touches the pin display portions of the die-cushion pins to be used whose shim thicknesses are to be changed (collectively for those to be changed to the same shim thickness) in the 24 die-cushion pins to be used. On the screen 242*a* of the shim thickness setting device 240 illustrated in FIG. 14, the pin display portions of the touched four die-cushion pins to be used are displayed capable of being discriminated from the pin display portions of the other die-cushion pins to be used. Moreover, on the screen 242*f* of the shim thickness setting device 240, a message that "Set shim thickness of selected pin (group)" and the ten key 242*g* are displayed.

The user inputs the shim thickness set value again by the ten key 242*g* in order to change the shim thickness set value of the die-cushion pin to be used corresponding to the touched pin display portion. In this embodiment, since the crack 24*a* is generated at the corner part of the formed product 24 in the first forming trial as illustrated in FIG. 12B, the shim thickness set value in the vicinity of the corner part is changed from 0.5 mm to 0.3 mm. That is for the purpose of preventing a crack from being generated by lowering the wrinkle suppressing force (pressure) in the vicinity of the corner part.

Figure 15:
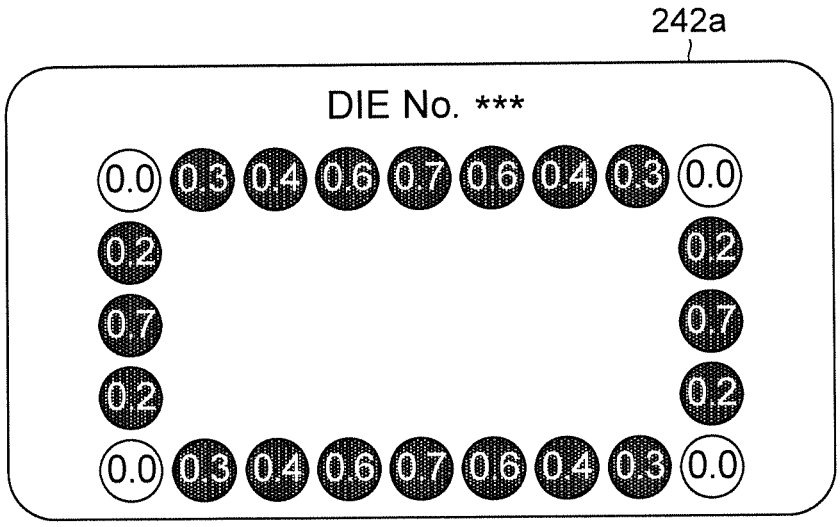
FIG. 15 is a diagram illustrating the shim thickness setting device 240 and particularly is a diagram illustrating a check screen of the shim thickness set value after a second shim thickness adjustment.

FIG. 15 illustrates a confirmation screen of the shim thickness set value after a second shim thickness adjustment. Finally, as illustrated on the screen 242*a* of the shim thickness setting device 240, the shim thickness set values in the vicinity of the four corner parts of the formed product are lowered for preventing a crack with respect to the first shim thickness set values and are (continuously) increased in order to suppress drawing wrinkles at the center part between the right and left as well as front and rear corner parts.

Then, similarly to the first shim adjustment, the user presses the execute button 242*e* so as to execute the second shim adjustment. In this case, it is preferable that the shim adjusting device 200 applies only the shim adjustment to the die-cushion pin to be used whose shim thickness set value was changed.

When the second shim adjustment is finished by the shim adjusting device 200, the user operates the press machine 10 and performs the second forming trial.

Figure 16A:
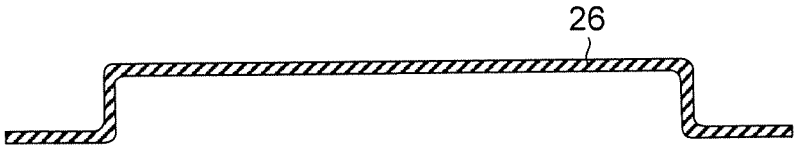
FIGS. 16A and 16B are respectively a sectional view and a plan view of a formed product 26 by a second forming trial in which the shim adjusting device 200 is made to function, respectively.
Figure 16B:
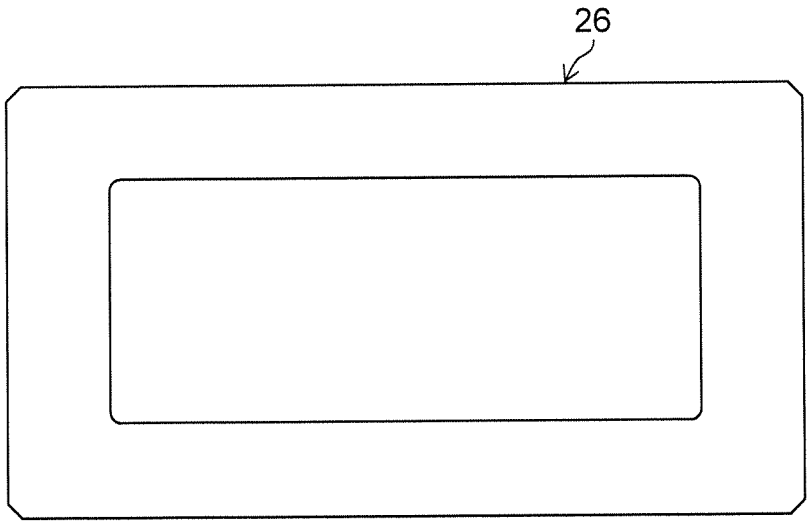

FIGS. 16A and 16B are respectively a sectional view and a plan view of a formed product 26 by the second forming trial in which the shim adjusting device 200 is made to function.

The formed product 26 illustrated in FIG. 16B becomes a quality product in which a crack at the corner part of the formed product disappears and drawing wrinkles at the center part between the front and rear as well as right and left corner parts of the formed product disappear as the result of proper shim adjustment.

As described above, when a quality product is formed, the user operates the operation unit 246 functioning as the storage operation unit and causes a storage instruction for storing the selection information of use/non-use of each of the die-cushion pins set by the shim thickness setting device 240 and the shim thickness set value of each of the die-cushion pins when the quality product is formed in association with the die (die No.) in the storage unit 249 to be output from the operation unit 246 to the storage control unit 248.

When the storage instruction is input from the operation unit 246, the storage control unit 248 obtains the selection information of use/non-use of each of the die-cushion pins held in the buffer memory 244*a* and the shim thickness set value of each of the die-cushion pins from the buffer memory 244*a* and has them stored in association with the die No. subjected to the forming trial in the storage unit 249.

FIGS. 17 and 18 are lists illustrating the selection information of use/non-use of each of the die-cushion pins and the shim thickness set values stored in association with the die No. in the storage unit 249, respectively.

The selection information of use/non-use of each of the die-cushion pins illustrated in FIG. 17 is information corresponding to position information (C1 to C55) of the C-holes of each of the dies and formed in the bolster 13 into which the 55 die-cushion pins are inserted, and this information uses "1" for the die-cushion pin to be used for actual wrinkle pressing and "0" for the die-cushion pins not to be used for the wrinkle pressing in the 55 die-cushion pins.

According to this selection information of use/non-use of each of the die-cushion pins, whether each of the die-cushion pins is a die-cushion pin to be used or a die-cushion pin not to be used can be discriminated for all the die-cushion pins. For the die-cushion pin not to be used, the shim adjustment can be set to unnecessary (shim thickness=0).

The shim thickness set value of each of the die-cushion pins illustrated in FIG. 18 is information corresponding to position information (C1 to C55) of the C-holes of each of the dies and formed in the bolster 13 into which the 55 die-cushion pins are inserted and is a shim thickness set value of each of the die-cushion pins set for each of the die-cushion pins.

In the example illustrated in FIG. 18, the shim thickness set value (including the shim thickness set value=0) is set for all the die-cushion pins, but when there is the selection information of use/non-use of each of the die-cushion pins as illustrated in FIG. 17, it is only necessary that the shim thickness set value is set at least to the die-cushion pin to be used.

Moreover, in FIGS. 17 and 18, the selection information of use/non-use of each of the die-cushion pins corresponding to the 55 dies (dies No. 1 to No. 55) and the shim thickness set values are illustrated, but the shim thickness set values corresponding to several hundred dies can be stored in the storage unit 249.

As described above, since the shim thickness set value is stored in association with the die in the storage unit 249, when the die having experienced the shim adjustment by the shim adjusting device 200 is set on the press machine 10, the shim adjusting device 200 can automatically perform the shim adjustment by reading out the shim thickness set value stored in association with the set die from the storage unit 249 and by performing the shim thickness adjustment for each of the die-cushion pins based on the read-out shim thickness set value.

Shim Adjusting Method

Figure 19:
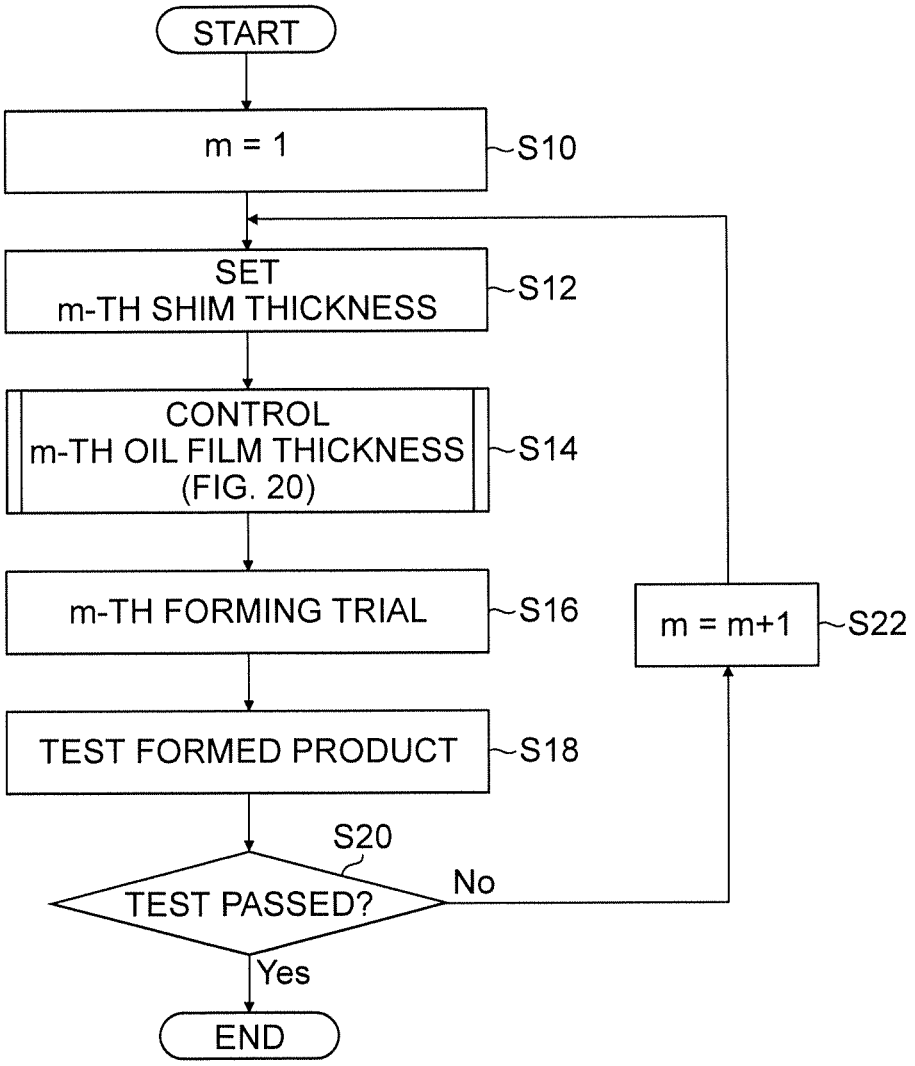
FIG. 19 is a flowchart illustrating a flow of the entire shim adjusting method.
Figure 20:
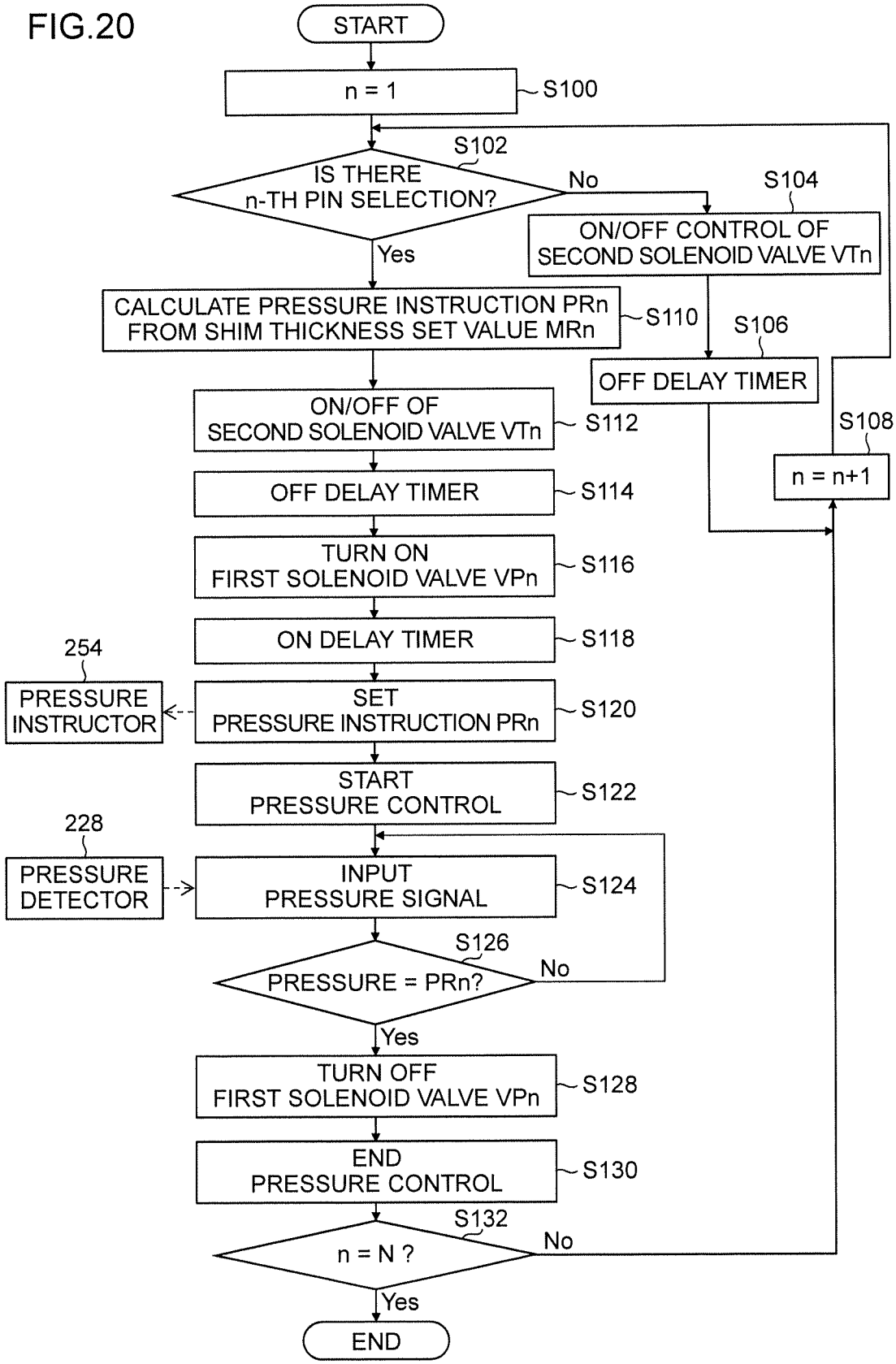
FIG. 20 is a flowchart illustrating an example of processing contents of Step S14 illustrated in FIG. 19.

FIGS. 19 and 20 are flowcharts illustrating an embodiment of a shim adjusting method using the shim adjusting device 200 according to the present invention.

FIG. 19 is a flowchart illustrating a flow of the entire shim adjusting method.

In FIG. 19, reference character m designates a parameter indicating the number of times of the shim adjustment, and the first shim adjustment is m=1 (Step S10).

The user operates the shim thickness setting device 240 of the shim adjusting device 200 and performs the m-th (the first time is m=1) setting of the shim thickness (Step S12).

When the m-th shim thickness setting is performed, the oil film thickness control device 250 controls the oil film thickness (cylinder internal pressure) of the rise-side pressurizing chamber 210*a* of each of the hydraulic cylinders 210 based on the shim thickness set value of each of the die-cushion pins for which the shim thickness was set.

FIG. 20 is a flowchart illustrating an example of processing contents of Step S14 illustrated in FIG. 19 and particularly is a flowchart illustrating an operation of the oil film thickness control device 250 of the shim adjusting device 200.

In FIG. 20, a parameter n is set to n=1 (Step S100). Here, the parameter n indicates a position number of any one die-cushion pin in the 55 die-cushion pins from No. 1 to No. 55, and n=1 indicates the No. 1 die-cushion pin.

The oil film thickness control device 250 determines whether or not the n-th die-cushion pin is a die-cushion pin to be used for wrinkle pressing based on the selection information (see FIG. 17) of use/non-use of each of the die-cushion pins input from the shim thickness setting device 240 (Step S102). If it is determined that the n-th die-cushion pin is a die-cushion pin not to be used (in the case of "No"), the routine proceeds to Step S104.

At Step S104, the second solenoid valve VTn provided correspondingly to hydraulic cylinder $\mathbf{210}_n$ for controlling the height direction position of the n-th die-cushion pin $\mathbf{102}_n$ is ON/OFF controlled. That is, the second solenoid valve VTn is turned ON, and the pressure of the rise-side pressurizing chamber 210*a* of the hydraulic cylinder $\mathbf{210}_n$ is depressurized. As a result, the oil film thickness of the rise-side pressurizing chamber 210*a* of the hydraulic cylinder $\mathbf{210}_n$ becomes 0. After the depressurization, the second solenoid valve VTn is turned OFF, and an OFF delay timer is counted (Step S106). The OFF delay timer is used for reliable depressurization by the second solenoid valve VTn.

Subsequently, in order that the subsequent die-cushion pin in the order is to be made an adjustment target, the parameter n indicating the position number of the die-cushion pin is incremented by only 1 (Step S108), and the routine proceeds to Step S102.

On the other hand, at Step S102, if it is determined that the n-th die-cushion pin is a die-cushion pin to be used (in the case of "Yes"), the routine proceeds to Step S 1 10. The hydraulic cylinder $\mathbf{210}_n$ faced with the n-th die-cushion pin $\mathbf{102}_n$ in this case is the hydraulic cylinder 210 as an adjustment target.

At Step S110, a shim thickness set value MRn set correspondingly to the n-th die-cushion pin $\mathbf{102}_n$ is obtained from the shim thickness set value (see FIG. 18) of each of the die-cushion pins input from the shim thickness setting device 240 and calculates a pressure instruction PRn from the obtained shim thickness set value MRn. This pressure instruction PRn can be calculated by substituting the shim thickness set value MRn for the oil film thickness X in [Equation 1] described above.

Subsequently, the second solenoid valve VTn provided correspondingly to the hydraulic cylinder $\mathbf{210}_n$ and controlling the height direction position of the n-th die-cushion pin $\mathbf{102}_n$ is ON/OFF controlled (Step S112), the second solenoid valve VTn is turned OFF after depressurization of the hydraulic cylinder $\mathbf{210}_n$, and the OFF delay timer is counted (Step S114). The OFF delay timer reliably turns OFF the second solenoid valve VTn and the routine proceeds to the subsequent processing (ON control of the first solenoid valve VPn which will be described later).

Subsequently, the first solenoid valve VPn provided correspondingly to the hydraulic cylinder $\mathbf{210}_n$ as an adjustment target depressurized at Steps S112 and S114 and whose oil film thickness is made 0 is turned ON (Step S116), and an ON delay timer is counted (Step S118). The ON delay timer is used for proceeding to the subsequent processing (pressure control) after the first solenoid valve VPn is reliably turned ON.

After the ON delay timer has elapsed, the pressure instruction PRn calculated at Step S110 is set to the pressure instructor 254 of the pressure control device 252 (Step S120).

The pressure control device 252 controls the hydraulic device 220 so that the pressure of the rise-side pressurizing chamber 210*a* of the hydraulic cylinder $\mathbf{210}_n$ as an adjustment target through the hydraulic device 220 based on the pressure instruction PRn set to the pressure instructor 254 becomes a pressure corresponding to the pressure instruction PRn (Steps S122 to S130), whereby the oil film thickness of the rise-side pressurizing chamber 210*a* of the hydraulic cylinder $\mathbf{210}_n$ as an adjustment target is adjusted.

That is, the pressure control device 252 calculates a torque instruction signal for controlling a torque of the servomotor 221 based on the pressure instruction PRn set to the pressure instructor 254 and the pressure signal input from the pressure detector 228 and outputs the calculated torque instruction signal to the servomotor 221 through the servo amplifier 229, and when the pressure detected by the pressure detector 228 reaches a pressure corresponding to the pressure instruction PRn (Step S126), the first solenoid valve VPn which was turned ON at Step S116 is turned OFF, and the pressure control (oil film thickness control) to the hydraulic cylinder $\mathbf{210}_n$ as an adjustment target is finished (Step S130).

When the pressure control to the hydraulic cylinder $\mathbf{210}_n$ as the adjustment target is finished, it is determined whether or not the parameter n has reached N (=55) (that is, whether or not the pressure control (including depressurization control) to all the 55 die-cushion pins has been finished) (Step S132), and in the case of n=N (in the case of "No"), the parameter n is incremented only by 1 at Step S108 and then, the routine proceeds to Step S102.

On the other hand, if it is determined to be n=N at Step S132 (in the case of "Yes"), it means that the pressure control (oil film thickness control) to all the die-cushion pins has been finished, and the m-th oil film thickness control is finished.

Returning to FIG. 19, when the m-th oil film thickness control is finished, the user operates the press machine 10 and performs the m-th forming trial (in the case of m=1, the first forming trial) (Step S16).

The user tests the formed product which was press-formed in the m-th forming trial (Step S18). The test of the formed product is a test which examines occurrence and a degree of a crack at what spot in the formed product or occurrence and a degree of a drawing wrinkle at what spot in the formed product and the like.

The user determines whether or not the formed product press-formed in the forming trial is a formed product having a desired quality by a forming result (test result) of the formed product (Step S20) and if it is determined that the formed product is not a formed product having a desired quality (fails the test) (in the case of "No"), m is incremented only by 1 (Step S22), and the routine returns to Step S12 and the "m-th shim thickness setting" in which m is incremented and the like are performed by referring to the forming result of the formed product.

As described above, the shim adjustment and the forming trial are repeatedly executed until the formed product having a desired quality is press-formed.

According to the present invention, the conventional manual shim adjustment (manual work) which took approximately 5 minutes of shim adjustment work time at one spot in one session can be reduced to approximately 30 seconds, whereby a series of the shim adjustment works which required a half day in total can be completed in approximately 30 minutes or reduction of the shim adjustment work time can be utilized for checking of formability or fine adjustment (an increase of the number of adjustment times), whereby product accuracy can be improved.

Moreover, regarding the shim thickness, the conventional stepped adjustment type using a plank (fragment) (if a 0.2-mm plank is not sufficient, a 0.4-mm plank is used or the like, for example) becomes the non-stage type in the shim adjusting device 200, whereby adjustment accuracy is improved.

Moreover, since the device is simple (the hydraulic device 220 is simple and only one unit of the pressure detector 228 is used), the shim adjusting device 200 can be constituted inexpensively.

Furthermore, in the conventional manual shim adjustment (by a manual work), it is difficult to check the set shim thickness. Even if a shim falls off, for example, it can be found only after a check with a lot of labors. Such a situation can often occur that an operator assumes that the shim is attached and tries to evaluate the subsequent result, but actually, the shim is not located at a predetermined position. According to the shim adjusting device 200, such a problem does not occur.

Second Embodiment of Shim Adjusting Device of Die-Cushion Device

Figure 21:
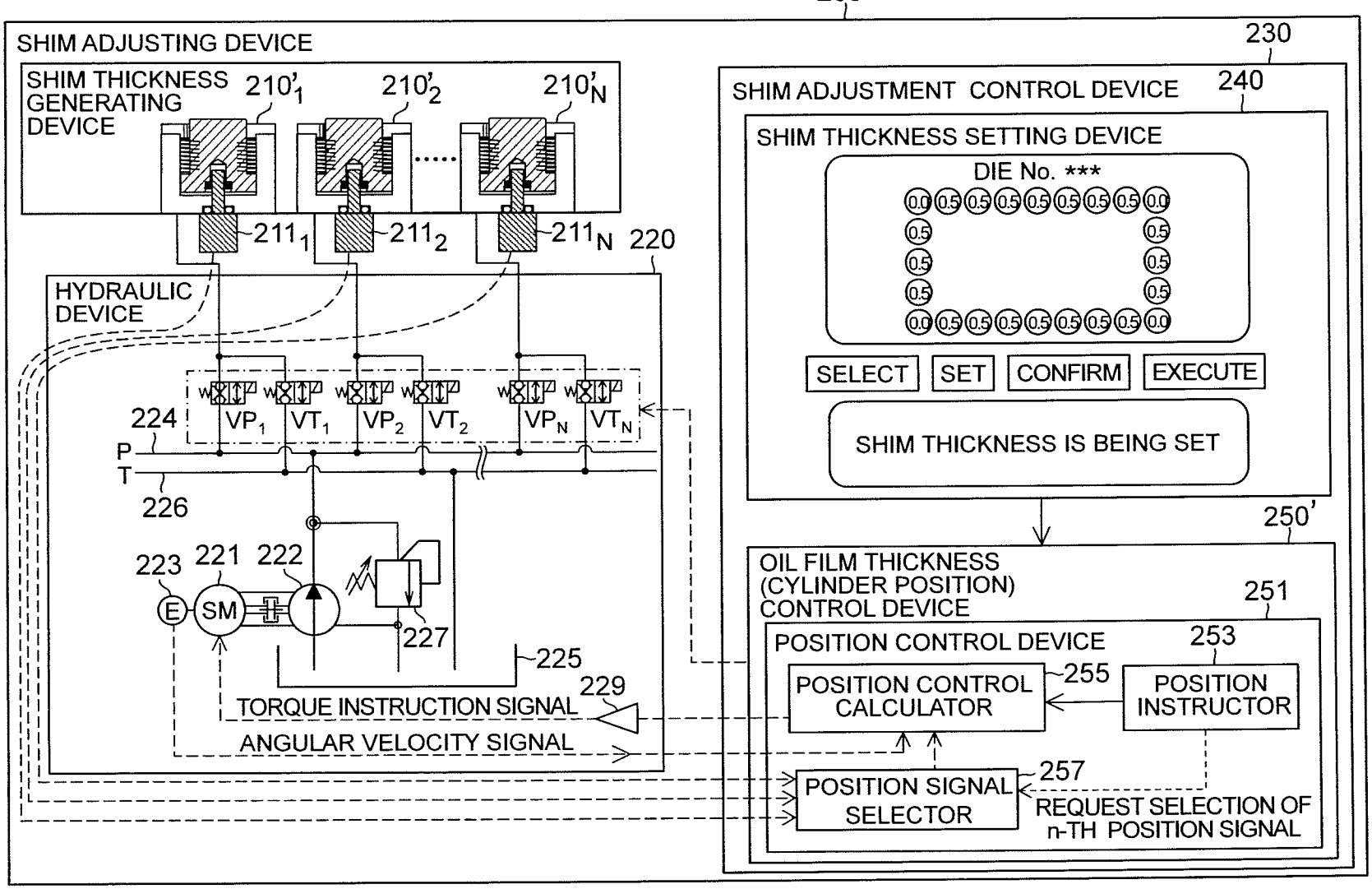
FIG. 21 is a block diagram of an essential part illustrating a second embodiment of a shim adjusting device of a die-cushion device according to the present invention.

FIG. 21 is a block diagram of an essential part illustrating a second embodiment of a shim adjusting device of a die-cushion device according to the present invention. The same reference numerals are given to portions in common with the shim adjusting device 200 in the first embodiment illustrated in FIG. 3, and its detailed description will be omitted.

In a shim adjusting device 200' of the second embodiment illustrated in FIG. 21, a plurality of (55) hydraulic cylinders 210' ($\mathbf{210}_1$', $\mathbf{210}_2$', . . . $\mathbf{210}_{N=55}$') functioning as shim thickness generating devices is different from the hydraulic cylinders 210 used in the first embodiment, and an oil film thickness control device 250' is different.

Figure 22:
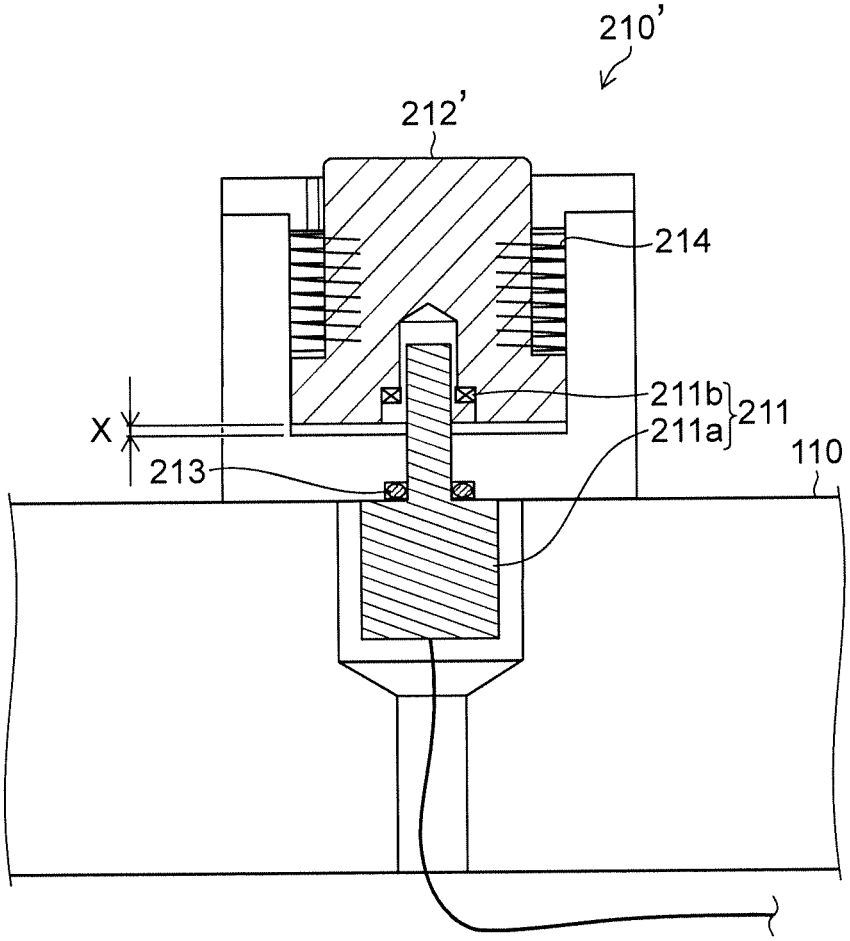
FIG. 22 is a longitudinal sectional view illustrating constitution of a hydraulic cylinder 210' and particularly is a diagram illustrating constitution of a position detector.

As illustrated in FIG. 22, the hydraulic cylinder 210' used in the shim adjusting device 200' of the second embodiment is different from the hydraulic cylinder 210 used in the shim adjusting device 200 of the first embodiment illustrated in FIG. 4 in a point that a position detector 211 which detects a height direction position of a piston rod 212' is incorporated.

The position detector 211 of this embodiment is a magnetostriction type displacement sensor which detects relative displacement between the piston rod 212' and the cylinder body of the hydraulic cylinder 210' and includes a sensor body 211*a* having a sensor rod portion and a ring-shaped magnet 211*b*.

The sensor body 211*a* is disposed on a bottom part of the hydraulic cylinder body and a rod portion is inserted into the hydraulic cylinder body. A seal member (O-ring) 213 is disposed between the hydraulic cylinder body and the rod portion so that the operating oil of the hydraulic cylinder 210' does not leak.

The magnet 211*b* is arranged in a hollow part formed on a lower part of the piston rod 212' in a state where the rod portion is inserted.

The position detector 211 which is a magnetostriction type displacement sensor is to detect a position of the piston rod 212' of the hydraulic cylinder 210' and sends out an excitation pulse to a magnetostriction line of the rod portion from the sensor body 211*a* and calculates a distance between the sensor body 211*a* and the magnet 211*b* based on time until a distortion pulse generated by action of an external magnetic field of the magnet 211*b* on the excitation pulse returns. That is, the position detector 211 detects the oil film thickness X of the rise-side pressurizing chamber of the hydraulic cylinder 210'.

Returning to FIG. 21, a position detection signal indicating the oil film thickness X of the rise-side pressurizing chamber of the hydraulic cylinder 210' detected by the 55 position detectors 211 ($\mathbf{211}_1$', $\mathbf{211}_2$', . . . $\mathbf{211}_N$') disposed on the 55 hydraulic cylinders 210' ($\mathbf{210}_1$', $\mathbf{210}_2$', . . . $\mathbf{210}_N$') is added to the position control device 251 (position signal selector 257) of the oil film thickness control device 250'.

The oil film thickness control device 250 of the first embodiment controls the oil film thickness (shim thickness) of the rise-side pressurizing chamber 210*a* by controlling the pressure of the rise-side pressurizing chamber 210*a* of each of the hydraulic cylinders 210, while the oil film thickness control device 250' of the second embodiment controls the oil film thickness (shim thickness) of the rise-side pressurizing chamber by controlling the cylinder position (piston rod position) of each of the hydraulic cylinders 210', which is different from the oil film thickness control device 250 of the first embodiment.

Therefore, the oil film thickness control device 250' of the second embodiment includes the position control device 251.

The position control device 251 includes a position instructor 253, a position control calculator 255, and a position signal selector 257.

In the position instructor 253, the shim thickness set value corresponding to the die-cushion pin as an adjustment target in the shim thickness set value of each of the die-cushion pins input from the shim thickness setting device 240 is set as a position instruction, and the position instructor 253 outputs the set position instruction to the position control calculator 255.

To the other inputs of the position control calculator 255, a position detection signal selected by the position signal selector 257 and an angular velocity signal indicating an angular velocity of the drive shaft of the servomotor 221 detected by the encoder 223 are added.

The position signal selector 257 selects a position detection signal input from the position detector 211 disposed on the hydraulic cylinder 210' faced with the die-cushion pin as an adjustment target in the position detection signals input from the 55 position detectors 211 and outputs the selected position detection signal to the position control calculator 255.

The position control calculator 255 calculates a torque instruction signal for controlling the torque of the servomotor 221 based on the position instruction input from the position instructor 253 and the position detection signal input from the position signal selector 257. By outputting this calculated torque instruction signal to the servomotor 221 through the servo amplifier 229 so as to control the operating oil ejected from the hydraulic pump 222 driven by the servomotor 221, position control is executed so that the position of the piston rod 212' of the hydraulic cylinder 210' as an adjustment target comes to a position corresponding to the position instruction. The angular velocity signal input from the encoder 223 is used for compensation for stable control of the operating oil.

Since the shim adjusting device 200' of the second embodiment performs the shim adjustment by individually controlling the positions of the plurality of (55) hydraulic cylinders 210' one by one as described above, the pressure detector is not needed, but the position detector 211 needs to be provided at each of the hydraulic cylinders 210'.

Moreover, the shim adjusting device 200' of the second embodiment is of a position control type in which the shim thickness (oil film thickness) as an adjustment target is directly controlled and has control accuracy of the oil film thickness improved as compared with the shim adjusting device 200 of the first embodiment of the pressure control type.

On the other hand, a large number of the position detectors are needed, which increases the number of signal lines (they need to be made movable) and also increases the number of channels input into the position control device 251 and thus, the device is made complicated and a cost is raised.

Others

In this embodiment, the case where the 55 hydraulic cylinders are provided on the cushion pad is described, but the number of the hydraulic cylinders is not limited to this embodiment.

Moreover, in this embodiment, the case where oil is used as the operating fluid of the shim adjusting device is described, but this is not limiting, and water or other fluids may be used.

Furthermore, the present invention is not limited to constitution of the die-cushion device but can be applied to the shim adjusting device of any type of the die-cushion devices.

Moreover, it is needless to say that the present invention is not limited to the aforementioned embodiments but is capable of various improvements and variations within a range not departing from the gist of the present invention.

What is claimed is:

1. A shim adjusting device of a die-cushion device having a cushion pad and die-cushion pins, the die-cushion pins being inserted into respective die-cushion pin holes formed in a bolster of a press machine, the cushion pad supporting a blank holder through the die-cushion pins, the shim adjusting device comprising:

fluid pressure cylinders respectively including 1) piston rods and 2) rise-side side pressurizing chambers, the fluid pressure cylinders disposed on the cushion pad and respectively aligned with the die-cushion pin holes of the bolster of the press machine such that lower ends of the die cushion pins are in contact with the respective piston rods of the fluid pressure cylinders;

a fluid pressure pump configured to supply an operating fluid independently to the rise-side pressurizing chambers of the fluid pressure cylinders, or discharge the operating fluid independently from the rise-side pressurizing chambers; and a shim thickness setting device configured to cause the fluid pressure pump to 1) supply the operating fluid independently to one or more rise-side pressurizing chambers of the rise-side pressurizing chambers of the fluid pressure cylinders corresponding to one or more die-cushion pins of the die-cushion pins inserted into the die-cushion pin holes, the one or more die-cushion pins being used to transmit, to the blank holder, a die-cushion cushion force generated when a slide of the press machine is lowered, and 2) independently adjust height direction positions of one or more piston rods of the piston rods of the fluid pressure cylinders corresponding to the one or more die-cushion pins.

2. The shim adjusting device according to claim 1, wherein the shim thickness setting device includes:

a die-cushion pin selector configured to select the one or more die-cushion pins from the die-cushion pins to be inserted into the die-cushion pin holes; and a shim thickness setter configured to set arbitrary shim thickness set values for the selected one or more die-cushion pins, and the shim thickness setting device causes, based on the shim thickness set values of the selected one or more die-cushion pins, the fluid pressure pump to 1) supply the operating fluid independently to the one or more rise-side pressurizing chambers of the fluid pressure cylinders corresponding to the selected one or more die-cushion pins, and 2) independently adjust the height direction positions of the one or more piston rods of the fluid pressure cylinders corresponding to the selected one or more die-cushion pins.

3. The shim adjusting device according to claim 2, wherein the shim thickness set values are stored in a memory in association with a die to be used in the press machine, and the shim thickness setting device causes, based on reading out the shim thickness set values stored in the memory in association with the die to be used in the press machine, the fluid pressure pump to 1) supply the operating fluid independently to the one or more rise-side pressurizing chambers of the fluid pressure cylinders corresponding to the selected one or more die-cushion pins, and 2) independently adjust the height direction positions of the one or more piston rods of the fluid pressure cylinders corresponding to the selected one or more die-cushion pins.

4. The shim adjusting device according to claim 2, wherein the die-cushion pin selector includes:

a display;

a first display control unit configured to display at least a first layout and a second layout on a screen of the display, the first layout illustrating a layout of the die-cushion pin holes or the die-cushion pins inserted into the respective die-cushion pin holes, the second layout illustrating a layout of one or more die-cushion pin holes of the die-cushion pin holes into which the one or more die-cushion pins are inserted or a layout of the one or more die-cushion pins; and a first operation unit configured to edit the second layout in a dialogue manner while checking the first layout and the second layout displayed on the screen of the display, the first display control unit displays the second layout on the screen of the display in accordance with an operation input from the first operation unit, and the die-cushion pin selector selects the one or more die-cushion pins on the second layout displayed on the screen of the display.

5. The shim adjusting device of a die cushion device according to claim 4, wherein the shim thickness setter includes:

the display;

a second display control unit configured to display the shim thickness set values of the one or more die-cushion pins in association with the second layout displayed on the screen of the display; and a second operation unit configured to edit the shim thickness set value of the one or more die-cushion pins arbitrary shim thickness set values in dialogue manner, while checking the shim thickness set values displayed on the screen of the display, the second display control unit displays the arbitrary shim thickness set values edited in accordance with an operation input from the second operation unit on the screen of the display, and the shim thickness setter sets the arbitrary shim thickness set values displayed on the screen of the display as the shim thickness set values of the one or more die-cushion pins.

6. The shim adjusting device according to claim 5, wherein the second operation unit has a function of selecting the one or more die-cushion pins at the same time and editing the shim thickness set values of the selected one or more die-cushion pins at the same time into the same shim thickness set value.

7. The shim adjusting device according to claim 1, wherein each of the fluid pressure cylinders is a single-rod fluid pressure cylinder.

8. The shim adjusting device according to claim 1, wherein the fluid pressure pump includes:

a fluid pressure source;

a pressurization line through which the operating fluid is supplied from the fluid pressure source;

a tank line connected to a tank;

first solenoid valves disposed in respective first lines, the first lines being respectively provided to the rise-side pressurizing chambers of the fluid pressure cylinders, the first lines connecting the rise-side pressurizing chambers of the fluid pressure cylinders and the pressurization line; and second solenoid valves disposed in respective second lines, the second lines being respectively provided to the rise-side pressurizing chambers of the fluid pressure cylinders, the second lines connecting the rise-side pressurizing chambers of the fluid pressure cylinders and the tank line.

9. The shim adjusting device according to claim 8, wherein the first solenoid valves and the second solenoid valves are non-leak solenoid valves.

10. The shim adjusting device according to claim 8, wherein the shim thickness setting device 1) controls the first solenoid valves, the second solenoid valves, and the fluid pressure source based on identification information of the die-cushion pin holes or identification information of the die-cushion pins to be inserted into the die-cushion pin holes and at least the shim thickness set values of the one or more die-cushion pins, 2) independently supplies the operating fluid from the fluid pressure source to the rise-side pressurizing chambers of the fluid pressure cylinders corresponding to the one or more die-cushion pins, and 3) independently adjusts the height direction positions of the one or more piston rods of the fluid pressure cylinders corresponding to the one or more die-cushion pins.

11. The shim adjusting device according to claim 10, wherein the shim thickness setting device 1) selects one die-cushion pin of the one or more die-cushion pins as an adjustment target based on the identification information of the die-cushion pin holes or the identification information of the die-cushion pins to be inserted into the die-cushion pin holes, 2) adjusts a height direction position of one piston of the one or more piston rods of the fluid pressure cylinders corresponding to the selected one die-cushion pin based on one shim thickness set value of the shim thickness set values corresponding to the selected one die-cushion pin, and 3) adjusts all the height direction positions of the one or more piston rods of the fluid pressure cylinders corresponding to the one or more die-cushion cushion pins by sequentially switching the selected one die-cushion pin as the adjustment target among the one or more die-cushion pins.

12. The shim adjusting device according to claim 8, wherein the fluid pressure cylinders respectively include springs configured to urge the piston rods of the fluid pressure cylinders in a lowering direction, and the shim thickness setting device adjusts the height direction positions of the piston rods of the fluid pressure cylinders by controlling a pressure of the operating fluid supplied to the rise-side pressurizing chambers of the fluid pressure cylinders from the fluid pressure pump.

13. The shim adjusting device according to claim 12, wherein $K_{P/X}$=0.3MPa/mm to 30MPa/mm, where a displacement constant of a height position of the piston rod with respect to the pressure of the operating fluid made to act on the rise-side pressurizing chamber of the fluid pressure cylinder is $K_{P/X}$.

14. The shim adjusting device according to claim 12, wherein the springs included in the respective fluid pressure cylinders are disk springs and disposed in lowering-side pressurizing chambers of the fluid pressure cylinders.

15. The shim adjusting device according to claim 12, wherein the shim thickness setting device controls the operating fluid to be supplied to the rise-side pressurizing chambers of the fluid pressure cylinders from the fluid pressure pump based on pressure instructions of the rise-side pressurizing chambers of the fluid pressure cylinders calculated based on the shim thickness set values of the one or more die-cushion pins and the pressure of the rise-side pressurizing chambers of the fluid pressure cylinders.

16. The shim adjusting device according to claim 15, further comprising a pressure detector configured to detect a pressure generated in the pressurization line, wherein the shim thickness setting device 1) controls the pressure of the operating fluid supplied to the pressurization line from the fluid pressure source based on the pressure instructions of the rise-side pressurizing chambers of the fluid pressure cylinders calculated based on the shim thickness set values of the one or more die-cushion pins and the pressure detected by the pressure detector and 2) brings a pressure of a first rise-side pressurizing chamber of the rise-side pressurizing chambers of the fluid pressure cylinders corresponding to one first solenoid valve subjected to ON control in the first solenoid valves to a pressure corresponding to the pressure instruction.

17. The shim adjusting device according to claim 1, further comprising position detectors configured to detect the height direction positions of the piston rods of the fluid pressure cylinders, wherein the shim thickness setting device controls the operating fluid supplied to the rise-side pressurizing chambers of the fluid pressure cylinders from the fluid pressure pump based on the shim thickness set values and the height direction positions of the piston rods detected by the position detector.

18. A shim adjusting method of a die-cushion device using the shim adjusting device according to claim 1, the shim adjusting method comprising:

a first step of selecting the one or more die-cushion pins from the die-cushion pins to be inserted into the die-cushion pin holes;

a second step of setting arbitrary shim thickness set values for the selected one or more die-cushion pins;

a third step of, based on the arbitrary shim thickness set values set in the second step, independently adjusting the height direction positions of the one or more piston rods of the fluid pressure cylinders corresponding to the selected one or more die-cushion pins by causing the fluid pressure pump to supply the operating fluid independently to the one or more rise-side pressurizing chambers of the fluid pressure cylinders corresponding to the selected one or more die-cushion pins; and a fourth step of performing a trial by driving the slide of the press machine after adjustment by the third step, wherein processing from the second step to the fourth step is repeated until a desired product is formed by the trial at the fourth step.

* * * * *